US006740463B2

(12) United States Patent
Shigemori et al.

(10) Patent No.: US 6,740,463 B2
(45) Date of Patent: May 25, 2004

(54) METHOD FOR PRODUCING TONER BY MIXING COLORED PARTICLES AND OUTER-ADDITIVE BY MIXER WITH STIRRER OF HIGH SPEED ROTATION

(75) Inventors: Kazunori Shigemori, Tokyo (JP); Hidetoshi Azuma, Tokyo (JP); Yoshihiro Makuta, Tokyo (JP); Hirosi Yamamoto, Tokyo (JP); Nobuyasu Ota, Tokyo (JP); Kazuhiro Sato, Tokyo (JP); Ryuji Ota, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/174,533

(22) Filed: Jun. 19, 2002

(65) Prior Publication Data

US 2003/0049559 A1 Mar. 13, 2003

(51) Int. Cl.[7] ..... G03G 9/08

(52) U.S. Cl. ..... 430/137.18; 430/137.1; 430/105

(58) Field of Search ..... 430/137.18, 137.1, 430/105

(56) References Cited

U.S. PATENT DOCUMENTS 6,033,822 A * 3/2000 Hasegawa et al. ..... 430/137
6,042,033 A * 3/2000 Sugimoto et al. ..... 241/46.02
2001/0002305 A1 * 5/2001 Yuasa et al. ..... 430/110

* cited by examiner

*Primary Examiner*—John Goodrow
(74) *Attorney, Agent, or Firm*—Armstrong, Kratz, Quintos, Hanson & Brooks, LLP

(57) ABSTRACT

A method of producing a toner having a process of mixing colored particles and outer-additives by using a mixer with an agitating blade whose shaft portion is sealed with a gas having a flow rate of from 0.4 $m^3$/hr to 3 $m^3$/hr and which rotates at such a high speed as a peripheral speed at a tip of said agitating blade in a range of from 20 m/sec to 50 m/sec. When the colored particles and outer-additives are mixed with each other, there is no generation of aggregates thereby and the toner can be obtained at a high yield. Therefore the toner which hardly generates a white streak and fog, even after a long period of continuous operation of development of electrophotographs is performed, can be obtained.

18 Claims, 5 Drawing Sheets

METHOD FOR PRODUCING TONER BY MIXING COLORED PARTICLES AND OUTER-ADDITIVE BY MIXER WITH STIRRER OF HIGH SPEED ROTATION

TECHNICAL FIELD

The present invention relates to methods of producing toners for use in developing of electrophotographs in copying machines, printing machines and the like. And it relates more particularly to a method of producing a toner which method is high in production yield, which toner is stable in an electrostatic property and excellent in durability.

BACKGROUND ART

Ordinarily, an addition of an outer-additive to colored particles has conventionally been performed. An object of such an addition is to provide a toner to be obtained with flowability, to control an electrostatic property thereof and the like. Recently, an enhancement of a printing quality, particularly an enhancement of resolution, has strongly been required in an electrophotograph. Therefore, it is important to allow an outer-additive containing little aggregate to be firmly adhered to colored particles or to be partially embedded therein.

In order to allow the outer-additive containing little aggregate to be adhered to or partially embedded in the colored particles, a mixer with an agitating blade that rotates at a high speed has been used. Various types of conditions under which the outer-additive is added to the colored particles by using such a mixer have been studied.

Japanese Patent No. 2,921,174 discloses a technique in which, when an outer-additive is added to colored particles, a shear rate calculated on the basis of a tip speed of a blade in a mixer and a clearance between the blade and an inner wall of the mixer, and a mixing time of the outer-additive are allowed to be in a specified range. In this publication, it is disclosed that, by this technique, a toner for developing an electrostatic latent image that has a high frictional electrification property and good flowability, but does not generate a faulty transfer and an image defect can be obtained. Japanese Unexamined Patent Publication No. 120969/1995 discloses a technique in which, when an outer-additive is added to colored particles, a mixing apparatus comprising a mixing tank having a given capacity and an agitating blade which is rotatable such that it gives shear strength to particles is used while pressure inside a mixing vessel is reduced. In this publication, it is disclosed that, by this technique, a magnetic toner which has high flowability and a high electrostatic property and can perform development of an electrophotograph with an image quality of little fog and high density can be obtained. Further, Japanese Unexamined Patent Publication No. 319629/1998 discloses a technique in which, between a process of removing large-size particles and a process of adding an outer-additive, added is a process of premixing for crushing aggregated colored particles. In this publication, it is disclosed that, by this technique, it is possible to allow dispersion of an outer-additive in a toner to be uniform and also a toner which does not generate any thinning in an electrophotograph derived from insufficient flowability and fog of the electrophotograph derived from an insufficient frictional electrification property to be obtained.

DISCLOSURE OF THE INVENTION

The present inventors have examined these techniques in detail and found that said techniques are incapable of sufficiently crushing aggregated outer-additives and allowing the thus-crushed outer-additives to be firmly adhered to or partially embedded in colored particles. The present inventors have also found that, when a toner obtained by said techniques is used in development of an electrophotograph, problems that a white streak or fog is generated in the thus-produced electrophotograph still remain unsolved.

An object of the present invention is to provide a method for producing a toner which gives a high yield and generates a small quantity of aggregates after colored particles and an outer-additive are mixed with one another, in which the toner can form an image having little white streak and fog when it is used in development of an electrophotograph.

The present inventors have conducted an extensive study for attaining said object and, as a result, have found that, when colored particles and an outer-additive are mixed with one another, said object can be attained by allowing a flowing quantity of a gas sealing a shaft portion of an agitating blade of a mixer and a peripheral rate at a tip of the agitating blade to be values each in a specified range. The present invention has been accomplished on the basis of this finding.

Thus, according to the present invention, there is provided a method for producing a toner comprising a process of mixing colored particles and an outer-additive by a mixer with an agitating blade whose shaft portion is sealed by a gas having a flowing quantity of from 0.4 $m^3$/hr to 3 $m^3$/hr and which rotates at such a high speed as a peripheral speed at a tip thereof being from 20 m/sec to 50 m/sec. According to the present invention, the process of mixing the colored particles and the outer-additive by the mixer is denoted as a "process P4".

It is preferable that large-size particles are removed in advance from the colored particles used in the process P4. According to the present invention, the colored particles before the large-size particles are removed therefrom are denoted as "unrefined colored particles" and a process of obtaining the colored particles by removing the large-size particles from the unrefined colored particles is denoted as a "process P3".

It is more preferable that the process P3 is a process of removing the large-size particles from the unrefined colored particles by providing the unrefined colored particles to a screen having an opening of from 5 $\mu$m to 40 $\mu$m and allowing them to pass therethrough by using air flow. The reason for such preference is that, when development of an electrophotograph is performed by using a toner obtained by such a process, an image defect such as filming or a blank area is not generated and the process itself is low in cost, high in yield and easy in setting operational conditions.

It is preferable that the unrefined colored particles to be used in the process P3 are first prepared in a state of a dispersion liquid containing them and, then, are separated from the dispersion liquid by using a solid-liquid separator and, thereafter, are dried. According to the present invention, the unrefined colored particles which have been separated from the dispersion liquid containing them by using the solid-liquid separator, but have yet to be dried, namely, the unrefined colored particles before being dried, are denoted as "unrefined colored particles in a wet state", and a process of obtaining the unrefined colored particles in a wet state from the dispersion liquid of the unrefined colored particles by using the solid-liquid separator is denoted as "process P1" and, further, a process of drying said unrefined colored particles in a wet state to obtain the unrefined colored particles is denoted as "process P2".

It is more preferable that, in the process P1, the solid-liquid separator that is to be used at the end of the process P1 comprises a porous metallic body as a filter material. The reason for such preference is that, by adopting such a process, it is possible to efficiently separate the unrefined colored particles in a wet state from the dispersion liquid of the unrefined colored particles and, in such a process, there is no need for such maintenance as to change filter materials or the like and also, in such a process, a running cost is low.

It is more preferable that the process P2 is a process that vacuum-dries the unrefined colored particles in a wet state by using a vacuum dryer with an agitating blade under a condition that a transfer ratio R is in a range of from 40 to 500. The unrefined colored particles that have been subjected to such a process are low in a content of the large-size particles and, when development of electrophotograph is performed by using the toner that has been subjected to such a process, image defects such as filming and fog are not generated; therefore, such a process is efficient. On this occasion, transfer ratio $R=X*Y/Z$, wherein X [$m^3$/Hr] represents transfer flowing quantity of an agitating blade of a vacuum dryer; Y [Hr] represents a drying time; and Z [$m^3$] represents a provided volume quantity of the unrefined colored particles in a wet state.

BEST MODE FOR CARRYING OUT THE INVENTION

Figure 1:
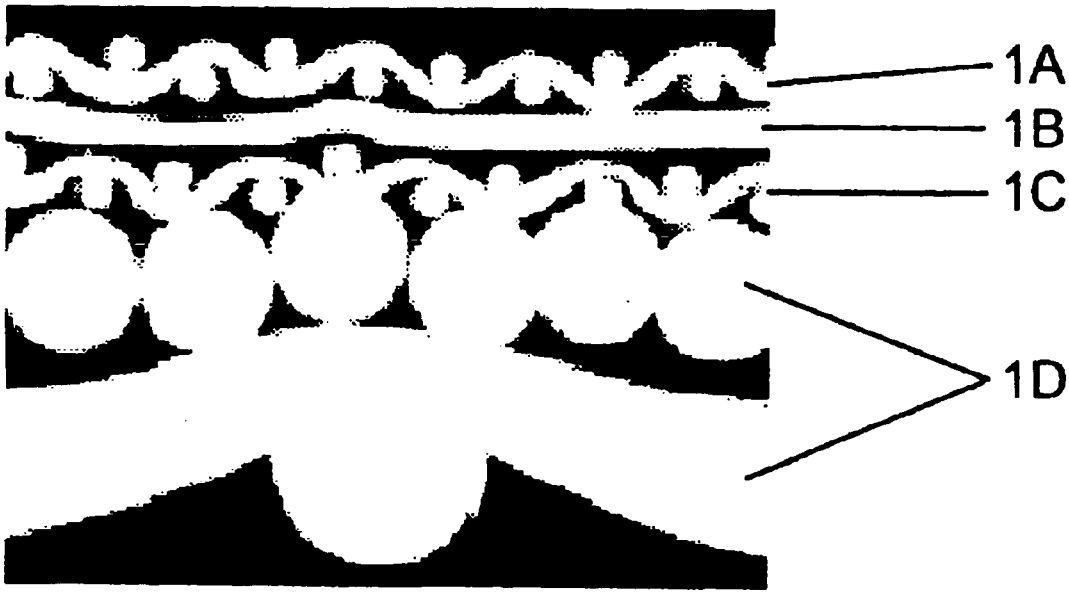
FIG. 1 is a schematic diagram showing an example of filtering material capable of being used in a process P1.

Colored particles to be used in the present invention comprise at least a binder resin, a colorant and a charge control agent, and may optionally comprise other additives such as a parting agent and a magnetic material.

As the binder resin, thermoplastic resins that have conventionally been widely used in toners may be used. Examples of binder resins include polymers of styrene and substituted styrene such as polystyrene and polyvinyl toluene; copolymers of styrene such as a styrene-vinyl toluene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-maleic acid copolymer, and a styrene-maleic acid ester copolymer; and, further, a poly-methyl methacrylate, polyethylene, a polypropylene, a polyester, a polyamide, an epoxy resin, polyvinyl butyral, rosin, modified rosin, a terpene resin, a phenol resin, an aliphatic or aromatic hydrocarbon resin, an aromatic petroleum resin and the like. These resins can be used either alone or in any combination thereof.

As the colorant, carbon black, titanium black, magnetic powders, oil black, titanium white and any other appropriate pigments and dyes can be used either alone or in any combination thereof. When carbon black is used, it is preferable to use that having a primary particle diameter of from 20 nm to 40 nm. When the particle diameter is less than 20 nm, since carbon black may sometimes be aggregated, it is not uniformly dispersed in a toner whereupon the toner that gives much fog when it is used in development of an electrophotograph is sometimes produced. While, when the particle diameter is more than 40 nm, since many of polyvalent aromatic hydrocarbon compounds, which are generated when carbon black is produced, such as benzopyrene remain in a toner, there sometimes occurs an environmental safety problem.

To produce a full-color toner, ordinarily, a yellow colorant, a magenta colorant and a cyan colorant are used.

As the yellow colorant, a compound such as an azo type pigment or a condensed polycyclic pigment is used. Examples of such yellow colorants include C.I. Pigment Yellow 3, 12, 13, 14, 15, 17, 62, 65, 73, 83, 90, 93, 97, 120, 138, 155, 180, 181, 185, and 186.

As the magenta colorant, a compound such as an azo type pigment or a condensed polycyclic pigment is used. Examples of such magenta colorants include C. I. Pigment Red 48, 57, 58, 60, 63, 64, 68, 81, 83, 87, 88, 89, 90, 112, 114, 122, 123, 144, 146, 149, 163, 170, 184, 185, 187, 202, 206, 207, 209 and 251; and C. I. Pigment Violet 19.

As the cyan colorant, a copper phthalocyanine compound, a derivative thereof, an anthraquinone compound or the like is used. Examples of such cyan colorants include C. I. Pigment Blue 2, 3, 6, 15, 15:1, 15:2, 15:3, 15:4, 16, 17 and 60.

A quantity of such colorants is ordinarily from 1 part to 10 parts by weight based on 100 parts by weight of the binder resin.

As a charge control agent, any charge control agent which has conventionally been used in a toner can be used. Examples of such charge control agents include Bontron N01 (available from Orient Chemical Industries Ltd.), Nigrosine-Base EX (available from Orient Chemical Industries Ltd.), Spiron black TRH (available from Hodogaya Chemical Co., Ltd.), T-77 (available from Hodogaya Chemical Co., Ltd.), Bontron S-34 (available from Orient Chemical Industries Ltd.), Bontron E-81 (available from Orient Chemical Industries Ltd.), Bontron E-84 (available from Orient Chemical Industries Ltd.), and COPY CHARGE NX (available from Clariant Ltd.), COPY CHARGE NEG (available from Clariant Ltd.); further, copolymers each having a quaternary ammonium (or its salt) group described in Japanese Unexamined Patent Publication Nos. 60458/1988, 175456/1991, 243954/1991, 15192/1999 and the like, copolymers each having a sulfonic acid (or its salt) group described in Japanese Unexamined Patent Publication Nos. 217464/1989, 15858/1991 and the like can be synthesized thereby being used as a charge control agent (or a charge control resin).

Preferably, among these compounds, used is the charge control resin. Since the charge control resin has high compatibility with the binder resin and is colorless, it is preferable that, by using such a charge control resin, a toner whose chargeability is stable even when it is used for a high-speed continuous color printing can be obtained.

A glass transition temperature of the charge control resin is ordinarily from 40° C. to 80° C., preferably from 45° C. to 75° C. and more preferably from 45° C. to 70° C. When the glass transition temperature is too low, a shelf stability of the toner to be obtained becomes deteriorated, while, when it is too high, fixing ability of the toner to be obtained is sometimes deteriorated.

A quantity of the charge control agent is ordinarily from 0.01 part to 20 parts and preferably from 0.1 part to 10 parts by weight based on 100 parts by weight of the binder resin.

Examples of parting agents include low molecular weight polyolefin waxes such as low molecular weight polyethylene, low molecular weight polypropylene, and low molecular weight polybutylene; natural botanical waxes such as candelilla, carnauba, rice, Japan wax, and jojoba; petroleum waxes and modified waxes thereof such as paraffin, microcrystalline, and petrolatum; synthetic waxes such as Fischer-Tropsch wax; polyfunctional ester compounds such as pentaerythritol tetramyristate, pentaerythritol tetrapalmitate, and dipentaerythritol hexamyristate; and other appropriate waxes. These waxes can be used either alone or in any combination thereof.

Among these, the synthetic waxes, terminal-modified polyolefin waxes, the petroleum waxes and the polyfunctional ester compounds are preferable. Among the synthetic waxes, the Fischer-Tropsch wax is particularly preferable. Among the polyfunctional ester compounds, polyvalent ester compounds such as pentaerythritol esters which show endothermic peak temperature within a range of from 30° C. to 200° C., preferably from 40° C. to 160° C. and more preferably from 50° C. to 120° C. and dipentaerythritol esters which show endothermic peak temperature within a range of from 50° C. to 80° C. are particularly preferable. The reason for such preference is that a balance between fixing and peeling properties of the toner to be obtained is excellent. Among said polyvalent ester compounds, such a polyvalent ester compound which has a molecular weight of 1,000 or more, can dissolve in a proportion of 5 parts by weight or more, based on 100 parts by weight of styrene, at 25° C. and has an acid value of 10 mg/KOH or less is more preferable. The reason for such preference is that, by using the toner to be obtained, a distinguished effect in lowering a fixing temperature at the time of development of the electrophotograph is exhibited. Said endothermic peak temperatures are values measured in accordance with ASTM D3418-82 and, then, obtained from a DSC curve determined by means of a differential scanning calorimeter while the toner is heated.

A quantity of said parting agent is ordinarily from 0.5 part to 50 parts and preferably from 1 part to 20 parts, by weight based on 100 parts by weight of the binder resin.

The colored particles to be used in the present invention may contain a magnetic material. Examples of such magnetic materials include iron oxides such as magnetite, γ-iron oxide, ferrite and iron-redundant type ferrite; metals having a paramagnetic property such as iron, cobalt and nickel and alloys or mixtures thereof with other metals such as aluminum, cobalt, copper, lead, magnesium, tin, zinc, antimony, beryllium, bismuth, cadmium, calcium, manganese, selenium, titanium, tungsten and vanadium.

The colored particles may be so-called core-shell type (also called as capsule type) particles that can be obtained by combining two polymers which are different from each other, where one polymer is used in an inner portion (core layer) and the other polymer is used in an outer portion (shell layer). The core-shell type colored particles are preferable, since they have a structure that the inner portion (core layer) comprising a substance having a lower melting point is covered by a substance having a higher melting point. The reason for such preference is that, by using such colored particles, lowering of a fixing temperature of the toner to be obtained and a prevention of aggregation in storage are allowed to be well balanced. As a method for obtaining the core-shell type colored particles, for example, a spray-dry method, an interface reaction method, an in-situ polymerization method, and a phase separation method can be adopted. Particularly, the in-situ polymerization method and the phase separation method are preferable, since it is favorable in production efficiency. Further, core particles of the core-shell type colored particles may be obtained by any one of a crushing method, a polymerization method, an association method and a phase inversion emulsification method. A weight ratio of the core layer to the shell layer of the core-shell type colored particles is not particularly limited, but is ordinarily used in a range of from 80/20 to 99.9/0.1. When a ratio of the shell layer is too small, the shelf stability of the toner to be obtained becomes deteriorated, while, when the ratio of the shell layer is too large, the toner to be obtained sometimes becomes difficult to be fixed at a low temperature. An average thickness of the shell layer of the core-shell type colored particles is ordinarily from 0.001 μm to 1 μm, preferably from 0.003 μm to 0.5 μm, and more preferably from 0.005 μm to 0.2 μm. When the thickness becomes too large, the fixing property in development of the toner to be obtained becomes deteriorated, while, when the thickness becomes too small, there is a fear that the shelf stability of the toner to be obtained is deteriorated; therefore, these cases are unfavorable. It is not necessary that the shell layer covers all surfaces of the core particles that form the core-shell type colored particles. Regarding a core particle diameter and thickness of the shell layer of the core-shell type colored particles, when it is possible to observe the core layer and the shell layer by an electron microscope, the core particle diameter and the thickness of the shell layer thereof are directly determined by measuring a size and a shell thickness of a particle randomly chosen from a photograph thus observed, while, when it is difficult to observe the core layer and the shell layer by the electron microscope, they can be calculated by a particle diameter of the core particle and a quantity of a polymeric monomer, forming the shell layer, which has been used at the time of producing the colored particles.

The colored particles to be used in the present invention are not restricted by a production method thereof. For example, there are four methods as follows: (1) a crushing method in which a colorant, a charge control agent, a parting agent and the like are melt-mixed into a thermoplastic resin which is to be a binder resin component and, then, the resultant mixture is uniformly dispersed to produce a composition in a lump state and, thereafter, the thus-produced composition is crushed and optionally classified to obtain colored particles; (2) a polymerization method in which a colorant, a charge control agent, a parting agent and the like are dissolved or dispersed in a polymerizable monomer which is a starting material for a binder resin and, then, a polymerization initiator is added to the resultant solution or dispersion to produce a mixture and, thereafter, the thus-produced mixture is suspended in an aqueous dispersion medium containing a dispersion stabilizer and heated up to a predetermined temperature to be polymerized thereby producing a dispersion liquid of unrefined colored particles and, then, the unrefined colored particles are obtained from the thus-produced dispersion liquid of unrefined colored particles by means of fractionation and dried to obtain colored particles; (3) an association method in which particles of a binder resin in a dispersion liquid obtained by emulsion polymerization or suspension polymerization and particles containing a colorant and a charge control agent are associated with one another and, then, the thus-associated particles are subjected to heat treatment to produce a dispersion liquid of unrefined colored particles and, thereafter, the unrefined colored particles are obtained from the thus-produced dispersion liquid of unrefined colored particles by means of fractionation and dried to obtain colored particles; and (4) a phase inversion emulsification method in which a colorant, a charge control agent and the like are added to a hydrophilic group-containing resin that is allowed to be a binder resin and dissolved in an organic solvent and, then, the thus-dissolved resin is subjected to phase inversion by being neutralized to produce a dispersion liquid of unrefined colored particles and, thereafter, the unrefined colored particles are obtained from the thus-produced dispersion liquid of unrefined colored particles by means of fractionation and dried to obtain colored particles. It is preferable that the colored particles obtained by the polymerization method denoted by (2) among these four methods are used. The reason for such preference is that, when a toner to be obtained is used in development of an electrophotograph, a dot reproduction property of the electrophotograph comes to be favorable.

When the colored particles are obtained by the polymerization method denoted by (2), a method of polymerizing the binder resin may be any known method in the prior art; on this occasion, examples of such methods include an emulsion polymerization method, a suspension polymerization method, and a dispersion polymerization method. Among these methods, the suspension polymerization method is preferable. The reason for such preference is that, when a toner to be obtained is used in development of an electrophotograph, a dot reproduction property of the electrophotograph comes to be favorable. Further, when polymerization of the polymerizable monomer is carried out, such polymerization may be conducted either in one process or separately in two processes.

When the polymerization is separately conducted in two processes, for examples, two methods are mentioned as follows: (1) a method in which a composition of a monomer (polymerizable monomer for core) to be polymerized in a first process and that of a monomer (polymerizable monomer for shell) to be polymerized in a second process are allowed to be different from each other whereupon the core having a low Tg is formed by conducting polymerization in the first process while a layer (shell) having a high Tg is formed by conducting polymerization in the second process; and (2) a method in which, after a monomer is polymerized in a first process to form particles, a given polymer component is added to the thus-formed particles thereby allowing the given polymer component to be absorbed by or adhered to the thus-formed particles. These two methods are preferable, since the binder resin to be obtained becomes core-shell type particles. The reason for such preference is that a balance between a low-temperature fixing property and a high-temperature shelf stability of the toner to be obtained is excellent.

In the polymerization method denoted by 2), examples of such polymerizable monomers for obtaining the binder resin include a monovinyl monomer, a crosslinkable monomer, and a macromonomer. The polymerization of the polymerizable monomers is performed to obtain a binder resin component in colored particles.

Specific examples of monovinyl monomers include aromatic vinyl monomers such as styrene, vinyl toluene, and α-methylstyrene; acrylic acid, and methacrylic acid; acrylic acid derivatives such as methyl acrylate, ethyl acrylate, propyl acrylate, butyl acrylate, 2-ethylhexyl acrylate, cyclohexyl acrylate, isobornyl acrylate, dimethylaminoethyl acrylate, and acrylamide; methacrylic acid derivatives such as methyl methacrylate, ethyl methacrylate, propyl methacrylate, butyl methacrylate, 2-ethylhexyl methacrylate, dicyclohexyl methacrylate, isobornyl methacrylate, dimethylaminoethyl methacrylate, and methacrylamide; monoolefin monomers such as ethylene, propylene, and butylene; and other appropriate monovinyl monomers. These monovinyl monomers may be used either individually or in any combination thereof. Among these monovinyl monomers, an aromatic vinyl monomer alone, a combination of the aromatic vinyl monomer and a acrylic acid derivative (or a methacrylic acid derivative), or the like is favorably used.

A crosslinkable monomer or a crosslinkable polymer is preferably used along with the monovinyl monomer, because hot offset resistance of the toner to be obtained is improved. The crosslinkable monomer is a monomer having two or more vinyl groups. Examples of such crosslinkable monomers include aromatic divinyl compounds such as divinylbenzene, divinylnaphthalene and derivatives thereof; di-ethylenically unsaturated carboxylic acid esters such as ethylene glycol dimethacrylate and diethylene-glycol dimethacrylate; compounds having two vinyl groups such as N,N-divinylaniline and divinyl ether; compounds having three or more vinyl groups such as pentaerythritol triallylether and trimethylolpropane triacrylate; and other appropriate crosslinkable monomers. The crosslinkable polymer is a polymer having two or more vinyl groups in the polymer. Examples of such crosslinkable polymers include polymers, each having two or more hydroxyl groups in a molecule, of polyethylene, polypropylene, polyesters, and polyethylene glycol; and esters to be obtained by subjecting unsaturated carboxylic acid monomers such as acrylic acid and methacrylic acid to a condensation reaction. These crosslinkable monomers or crosslinkable polymers may be used either individually or in any combination thereof. A quantity of each or these crosslinkable monomers or crosslinkable polymers to be used is ordinarily 10 parts by weight or less, preferably from 0.1 part to 2 parts by weight, based on 100 parts by weight of the monovinyl monomer.

Further, it is preferable that a macromonomer is used together with the monovinyl monomer. The reason for such preference is that a balance between a high-temperature shelf stability and a low-temperature fixing property in development of the toner to be obtained becomes favorable. The macromonomer has a polymerizable carbon-carbon unsaturated bond at a terminal of a molecular chain thereof, and it is an origomer or a polymer having a number average molecular weight of ordinarily from 1,000 to 30,000. When the number average molecular weight is too small, since a surface portion of particles becomes soft, the shelf stability of the toner to be obtained becomes deteriorated. On the other hand, when the number average molecular weight is too high, since the macromonomer becomes difficult to be melted, the fixing property of the toner to be obtained becomes deteriorated. The macromonomer is preferably such that can produce a polymer having a higher glass transition temperature by being subjected to copolymerization than that of a polymer to be obtained by subjecting said monovinyl monomer to polymerization. Examples of such macromonomers include polymers to be produced by polymerizing one or any combination selected from the group consisting of styrene, styrene derivatives, methacrylic acid esters, acrylic acid esters, acrylonitrile and methacrylonitrile; and macromonomers each having a polysiloxane structure. Among these macromonomers, preferable is a polymer that is hydrophilic, particularly, obtained by polymerizing a methacrylic acid ester or an acrylic acid ester individually or in a combination thereof. An quantity of the macromonomer to be used is ordinarily from 0.01 part to 10 parts, preferably from 0.03 part to 5 parts and more preferably from 0.05 part to 1 part, by weight based on 100 parts by weight of the monovinyl monomer. When the quantity of the macromonomer is too small, the shelf stability of the toner to be obtained is not improved. On the other hand, when the quantity of the macromonomer is too large, the fixing property of the toner to be obtained becomes deteriorated.

In the cases of the polymerization method denoted by 2), the association method denoted by 3) and the phase inversion emulsification method denoted by 4), the unrefined colored particles are prepared in a state of the dispersion liquid containing them. On this occasion, it is preferable that the unrefined colored particles in a wet state are separated from said dispersion liquid by using a solid-liquid separator (process P1) and, then, the thus-separated unrefined colored particles in a wet state are dried (process P2) to prepare the unrefined colored particles.

In the process P1, it is preferable that a pH of the dispersion liquid of the unrefined colored particles is optionally adjusted. Such pH adjustment sometimes has an object of dissolving metallic hydroxide colloidal, having a property of being hardly soluble in water, which has been used in preparation of said dispersion liquid. When the pH adjustment is conducted on the basis of this object, it is preferable that an acid is used as a pH adjustment chemical such that the pH after such adjustment comes to be 6 or less. On this occasion, it is preferable that the chemical is sulfuric acid. The unrefined colored particles are allowed to be separated by using the solid-liquid separator from said dispersion liquid itself or, optionally, said dispersion liquid that has been subjected to the pH adjustment. The thus-separated unrefined colored particles may be transferred to a drying process P2 either as they are or after they are rinsed. Examples of such rinsing operations include an operation in which water is poured on the obtained unrefined colored particles; an operation in which the obtained unrefined colored particles is allowed to be in a state of slurry again by using water thereby producing a dispersion liquid and, then, the unrefined colored particles are separated from the thus-produced dispersion liquid by using a solid-liquid separator; and a combination thereof. The unrefined colored particles thus obtained may be transferred to the drying process P2 either as they are or after a moisture content thereof is reduced by using the solid-liquid separator once again. The resultant unrefined colored particles sometimes contain 30% by weight or more of moisture content; on this occasion, it is preferable that the resultant unrefined colored particles are subjected to an operation of reducing the moisture content thereof by the solid-liquid separator once again and, then, the thus-subjected unrefined colored particles are transferred to the drying process P2. In this case, it is preferable that a moisture content of the unrefined colored particles to be obtained is 20% by weight or less. According to the present invention, the unrefined colored particles which have been obtained by the process P1 and which is in a state before transferred to the process P2 are designated as the unrefined colored particles in a wet state.

Solid-liquid separation methods are roughly classified into filtration under reduced pressure, centrifugal filtration and pressure filtration. Examples of the solid-liquid separators include a continuous belt filter, a basket type centrifugal filter system, a filter press and a siphon pillar type centrifuge. These separators, irrespective of a type thereof, are ordinarily provided with a filtering material. The filtering material is not particularly limited; however, in a preferred process P1, the solid-liquid separator that is to be used at the end of the system uses a porous metallic body as the filtering material. The reason for such preference is that the unrefined colored particles in a wet state can effectively be separated from the dispersion liquid of the unrefined colored particles by adopting such a process, maintenance such as a change of filtering materials is not necessary in such a process, and a running cost is low in such a process.

It is more preferable that the porous metallic body to be used in said preferable process P1 is a metallic body that has a multiplicity of pores in a range of from 0.1 $\mu$m to several hundred $\mu$m diameter. Examples of such porous metallic bodies include a metallic plate having a multiplicity of pores formed therein, a single wire mesh, a laminate of a plurality of wire meshes, and a laminate of said metallic plate and the wire mesh. Among these things, the laminate of a plurality of wire meshes, the laminate of the metallic plate having a multiplicity of pores formed therein and the wire mesh are particularly favorable from the viewpoint of mechanical strength, pressure resistance, filtering precision and the like.

As the porous metallic body, when the laminate of a plurality of wire meshes or the laminate of the metallic plate having a multiplicity of pores formed therein and the wire mesh is used, it is preferable that a plurality of wire meshes are laminated with one another or the metallic plate having a multiplicity of pores formed therein and the wire mesh are laminated with one another and, then, the resultant laminate is subjected to a sintering treatment. By performing the sintering treatment, the wire mesh or the metallic plate which constitutes said laminate is allowed to be in an integrated state thereby further enhancing said characteristics.

A material of the porous metallic body is not particularly limited, but stainless steel is preferable from the viewpoint of excellent corrosion resistance and, further, corrosion resistant alloys such as hastelloy and carpenter are also preferable from the viewpoint of excellent corrosion resistance and heat resistance and, furthermore, heat resistant alloys such as inconel and a nickel-containing alloy are also preferable from the viewpoint of excellent heat resistance.

It is more preferable that a pore size of the porous metallic body used in said preferable process P1 is selected such that it is in a smaller range than that of a particle diameter of the unrefined colored particles which are subjected to a solid-liquid separation. The term "pore size" used herein is intended to include an opening of sieves or the like. Specifically, it is preferable that the pore size of the porous metallic body is in a range of from 0.3 $\mu$m to 5 $\mu$m. Further, among said porous metallic bodies, such a porous metallic body that has a narrow pore diameter distribution is favorable.

An example of the porous metallic body in which a plurality of wire meshes are laminated and, then, the thus-laminated wire meshes are subjected to a sintering treatment to be integrated is shown in FIG. 1. FIG. 1 is a schematic diagram showing a cross-section of a 5-layer laminated porous metallic body. Further, in FIG. 1, a portion shown in white represents a metallic portion, while a portion shown in black represents a hollow portion. Shown is a constitution thereof comprising a protective layer 1A, a filtering control layer 1B, a distribution layer 1C and a supporting layer 1D in this order from a side of a surface contacting the dispersion liquid of the unrefined colored particles. A solid component of the dispersion liquid of the unrefined colored particles is trapped on the surface of the filtering control layer 1B. Such filtration is referred to as surface filtration. The solid component is held only on the surface of the filtering control layer 1B such that it is not leaked into an outside portion. A number of wire meshes to be laminated and a size of an opening of the wire mesh are changeable depending on the particle diameter of the unrefined colored particles to be separated and operational conditions of the solid-liquid separator.

As employable solid-liquid separators in said preferable process P1, mentioned are a basket type centrifugal filter system, a filter system under pressure, a filter system under reduced pressure, a filter press and the like. Among these filter systems, the basket type centrifugal filter system is more preferable.

Figure 2:
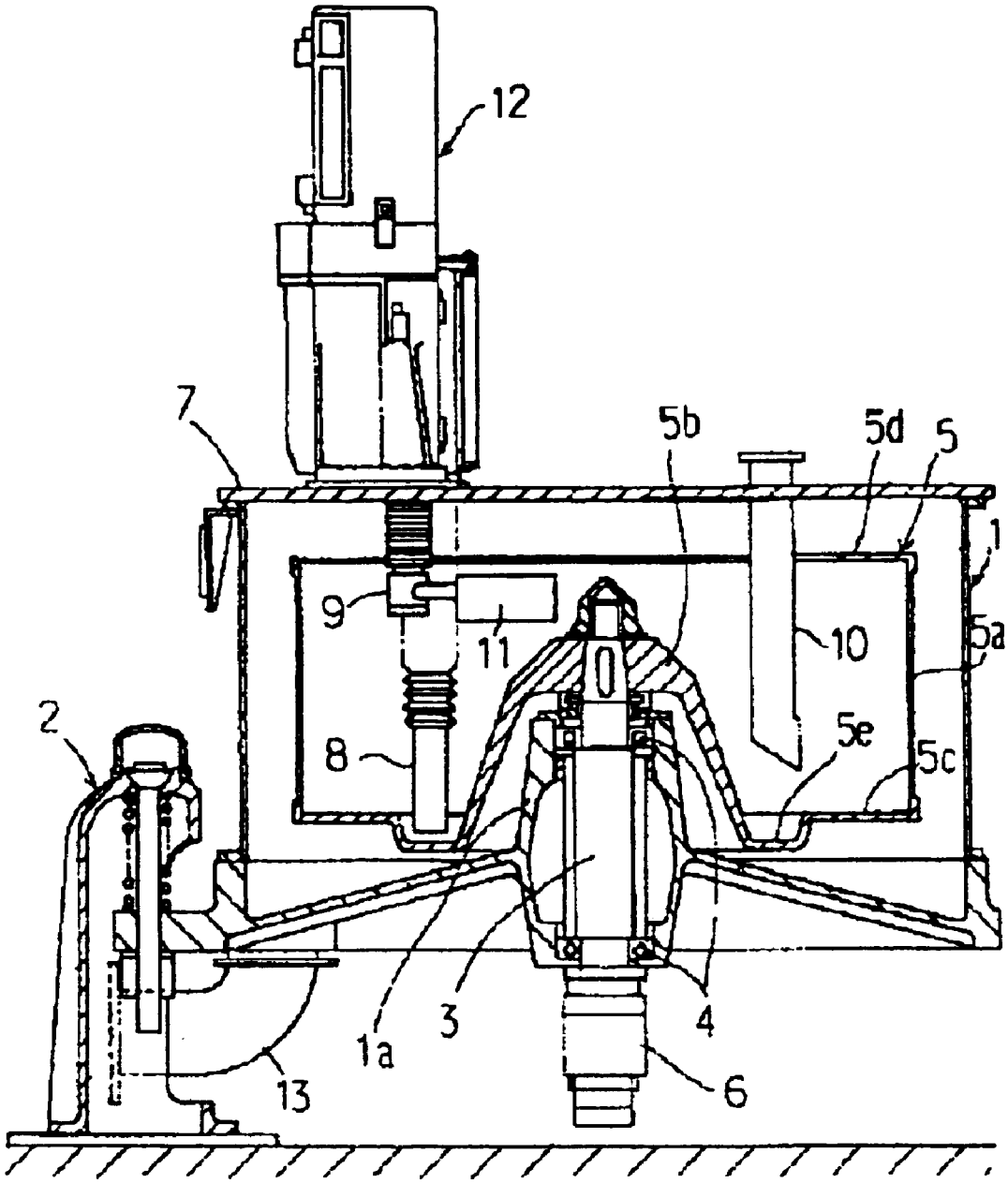
FIG. 2 is a schematic diagram showing an example of a solid-liquid separating device capable of being used in a process P1.

Such a preferable basket type centrifugal filter system is described in detail below with reference to the accompanying drawings. FIG. 2 is an example of the basket type centrifugal filter system. The basket type centrifugal filter system shown in FIG. 2 comprises a casing 1 supported via a buffer device 2, a rotary shaft 3 supported to a boss portion 1*a* via bearings 4, which boss portion is disposed in a center of a bottom of the casing 1, a basket 5 attached to the rotary shaft 3 and a filtering material 14 firmly fixed to a peripheral wall portion of the basket 5. In a separation method of this process, when the basket type centrifugal filter system is used as the solid-liquid separator, it is preferable that said porous metallic body is used as the filtering material 14.

The basket 5 comprises a peripheral wall portion 5*a* having a multiplicity of transmission pores, a bottom portion 5*c* having a boss portion 5*b* in a center thereof and an annular end portion wall 5*d* attached on an upper end of the peripheral wall portion 5*a*; on this occasion, the boss portion 5*b* attached in a center of the bottom portion is connected with an upper end of the rotary shaft 3. A lower end of the rotary shaft 3 is connected with an output shaft of a rotary primary drive 6 comprising a hydraulic motor, an inverter motor or the like which is attached to the bottom portion of the casing 1.

In a periphery of the boss portion 5*b* of the bottom of the basket 5, a continuous annular solid component housing groove 5*e* is formed in a peripheral direction, and a lower end of a solid component exhausting tube 8 which has been inserted in the basket 5 by allowing it to vertically pass in a flexible manner through a cover 7 that closes an upper opening of the casing 1 is inserted in the solid component housing groove 5*e*.

In the basket 5, inserted are a scraping blade drive shaft 9 and a liquid supply pipe 10; on this occasion, a scraping blade 11 is attached to a lower end of the scraping blade drive shaft 9. On an upper surface of the cover 7, attached is a scraping blade drive unit 12 which drives the scraping blade drive shaft 9 and, by the drive unit, the scraping blade 11 is not only vertically driven, but also rotated between a recess position in which the scraping blade 11 is retreated in a side of an inner diameter of the basket and an advanced position in which the scraping blade 11 is drawn near to the peripheral wall portion 5*a* of the basket.

In said centrifugal filter system, the basket 5 is rotate-driven by the rotary primary drive 6, and the dispersion liquid of the unrefined colored particles is provided into the basket 5 through the liquid supply pipe 10. The thus-provided liquid of the unrefined colored particles is separated by centrifugal force generated by rotation of the basket 5 to obtain the unrefined colored particles in a wet state and a filtrate. The thus-obtained filtrate is exhausted into the casing 1 through a transmission pore provided between the filtering material 14 and the peripheral wall portion 5*a* of the basket while the thus-obtained unrefined colored particles in a wet state form a cake layer on an inner periphery of the peripheral wall portion of the basket 5. The filtrate that has been exhausted into the casing 1 is exhausted outside the system through a liquid exhausting tube 13 connected to the bottom of the casing 1.

When the cake layer of the unrefined colored particles in a wet state having a predetermined thickness is formed on the inner periphery of the peripheral wall portion of the basket 5, supply of the dispersion of the unrefined colored particles is stopped and, then, a liquid removal process and a rinsing process are performed. Thereafter, a speed of the basket is reduced and, while the basket is rotating at a low speed, the scraping blade 11 is driven to a side of the peripheral wall portion of the basket to scrape the unrefined colored particles in a wet state formed on the inner periphery of the basket 5 down into a side of the solid component housing groove 5*e* (scraping process). The unrefined colored particles in a wet state collected in the solid component housing groove 5*e* are sucked by the solid component exhausting tube 8 which utilizes vacuum to be exhausted outside the system.

The basket type centrifugal filter systems are not limited to those described above but include a bottom portion exhausting type in which a solid component exhausting hole is installed in the bottom portion of the basket and, then, the solid component is exhausted through the solid component exhausting hole.

Methods for inserting the porous metallic body into the inner periphery of the basket include a method in which the metallic body is rolled and, then, end portions thereof in a peripheral direction are connected with each other and, thereafter, the resultant metallic body is inserted into the inner periphery of the peripheral wall portion of the basket; a method in which the metallic body is divided into a plurality of elements each formed in an arched shape such that each element goes along the inner periphery of the basket and, then, the thus-divided plurality of elements are inserted into the inner periphery of the peripheral wall portion of the basket such that the plurality of elements are aligned in a direction of the inner periphery of the basket and, thereafter, end portions in a peripheral direction of the-thus inserted plurality of elements are connected with one another; and the like. Among them, from the viewpoint of enhancing true circularity of the filtering material, preferable is a second one. By enhancing the true circularity, it becomes possible to sufficiently scrape the unrefined colored particles in a wet state formed on the inner periphery of the basket.

Examples of methods for connecting the end portions in a peripheral direction of the porous metallic body with one another include a method for connecting the end portions via a packing; a method for connecting the end portions by imparting a bump on each end portion; and a method for connecting the end portions by first imparting a bump on each end portion and, then, interposing a packing between any two bumps.

Examples of methods for firmly fixing the metallic body to an inner periphery of the basket include a method for attaching the metallic plate to the inner periphery of the metallic body by a fixing fitting; and a method for firmly fixing under pressure by first providing a groove in the bottom portion of the basket and, next, inserting an end of said metallic plate into the thus-installed groove and, then, inserting an O-ring to said groove.

As the process (process P2) for drying the unrefined colored particles in a wet state, a drying method by using a vacuum type dryer is ordinarily conducted.

A preferable process P2 is a process in which the unrefined colored particles in a wet state are vacuum dried by using a vacuum dryer with an agitating blade under a condition that a transfer ratio R is from 40 to 500. The reason for such preference is that, in the unrefined colored particles which have been subjected to such a condition, a content of large-size particles is small, and, when development of an electrophotograph is performed by using a toner which is obtained by subjecting them to such a process, an image defect such as filming or fog is not generated in the electrophotograph whereupon such a process is effective. On this occasion, the transfer ratio R=X*Y/Z, wherein X [$m^3$/Hr] represents a transfer flowing quantity of the agitating blade of the vacuum dryer; Y [Hr] represents a drying time; and Z [$m^3$] represents a provided volume quantity (volume before being dried) of the unrefined colored particles in a wet state.

In said preferable process P2, the employed vacuum dryer has the agitating blade therein. A type of the agitating blade is not particularly limited and, for example, a ribbon blade, a paddle blade, and a screw blade are illustrated. These agitating blades may swivel in the dryer.

As the vacuum dryer with such an agitating blade, illustrated are material agitation type vacuum dryers of, for example, a groove-base agitation type, a cylindrical agitation type, a conical screw agitation type, a conical ribbon agitation type, and a conical rotation type. Among these vacuum dryers, the vacuum dryers of the conical screw agitation type, the conical ribbon agitation type and the conical rotation type are favorably used. Such favorable vacuum dryers are available in the market; specific examples thereof include SV mixer, particularly, T series such as SV-001VT (available from Shinko Panteck K.K.), Ribocone (available from Ohkawara Seisakusho K.K.), and Nauta mixer (available from Hosokawa Micron K.K.).

Figure 3:
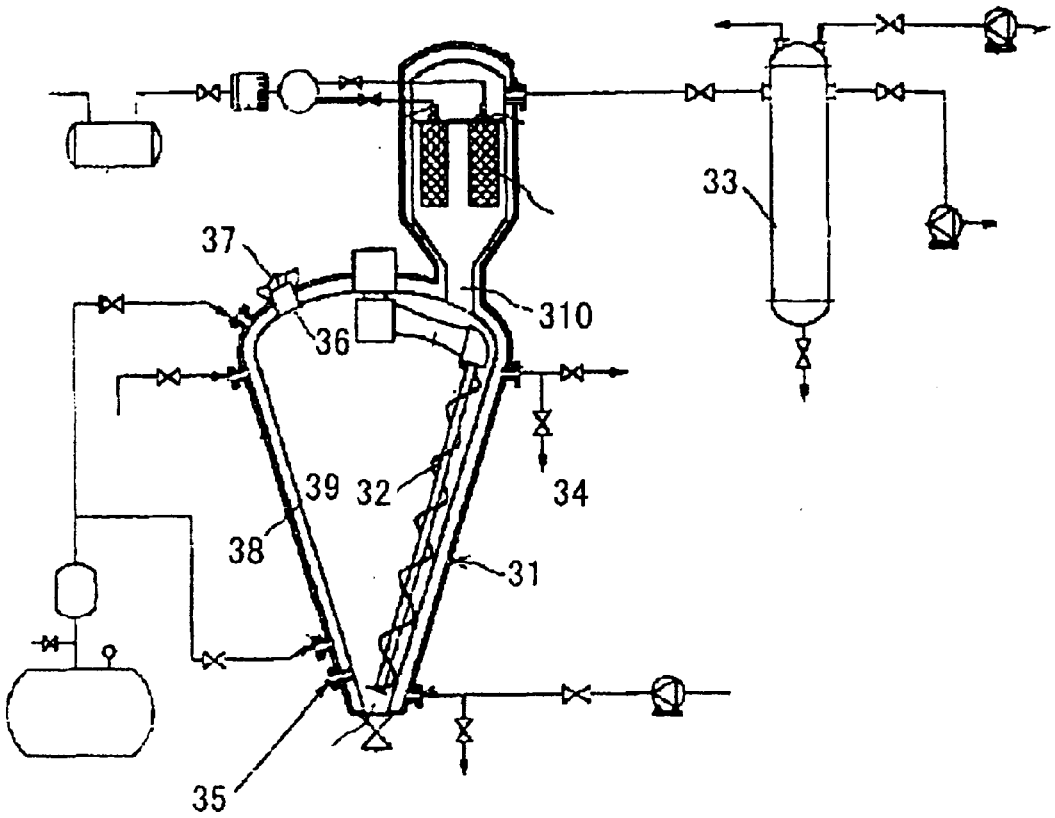
FIG. 3 is a schematic diagram showing an example of a dryer capable of being used in a process P2.
Figure 4:
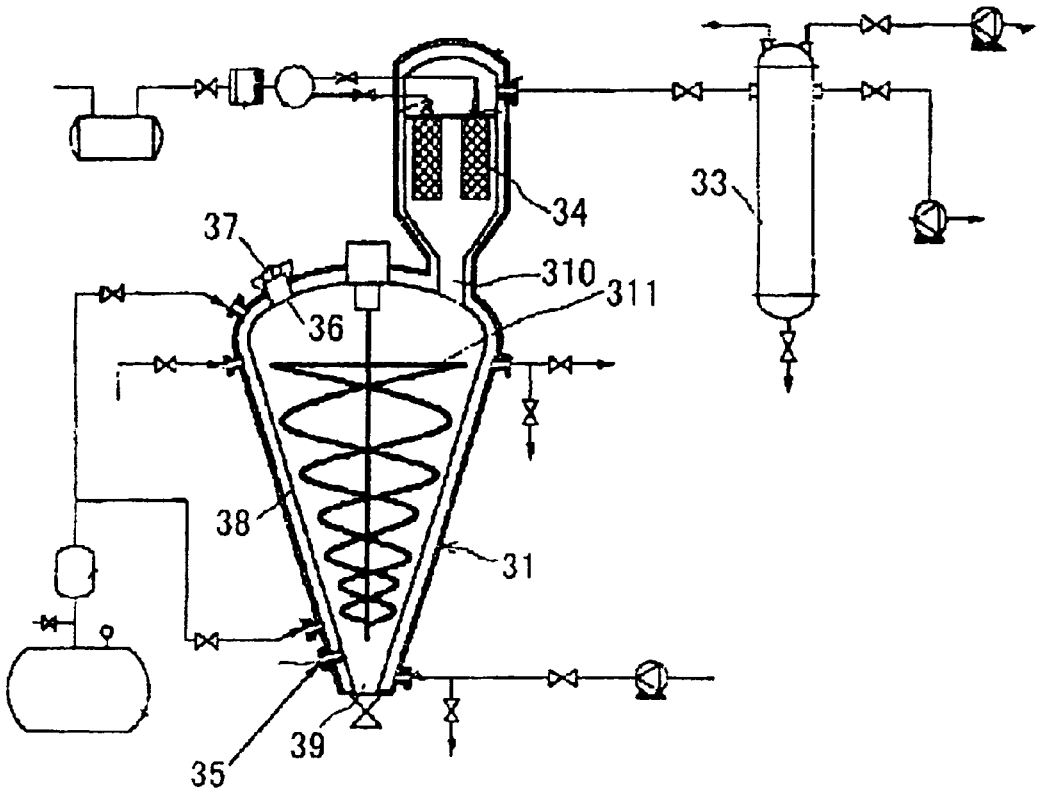
FIG. 4 is a schematic diagram showing an example of another dryer capable of being used in a process P2.

The favorable vacuum dryers used in said preferable process P2 are described in detail below with reference to the accompanying drawings. FIG. 3 is a schematic diagram of an example of a conical screw agitation type vacuum dryer, and FIG. 4 is a schematic diagram of an example of a conical ribbon agitation type vacuum dryer.

The vacuum dryer shown in FIG. 3 uses a screw type agitating blade 32 as an agitating blade. The agitating blade 32, which is installed in an upper portion of a drying vessel 38 in inverted conical form, is constituted such that it revolves (swivels) along an inner peripheral surface of the container 32 while it rotates (turns on its own axis). The unrefined colored particles in a wet state are provided from an un-dried article providing port 36 installed in the upper portion of the drying vessel 38 in inverted conical form, transferred in an upward direction along an inner wall of the drying vessel 38 by a rotation of the agitating blade 32 and, at a tip end of the agitating blade 32, are scattered around by rotation force thereof. Then, by a swivel to be conducted at the same time of the rotation of the agitating blade 32, the unrefined colored particles are imparted with a circular motion in a horizontal direction. Since the unrefined colored particles are transferred by the agitating blade 32 into the upward direction, a space is generated in the drying vessel 38 at a lower portion thereof whereupon the unrefined colored particles fall toward the space by gravity. As described above, the unrefined colored particles are repeatedly subjected to agitation and dispersion while the unrefined colored particles are lifted upward whereupon the unrefined colored particles in the drying vessel 38 can efficiently be agitated as a whole.

As shown in FIG. 3, in a case in which pressure inside the drying vessel 38 is reduced or the vacuum dry is performed while a gas is supplying, an exhaust port 310 for exhausting a gas from inside the drying vessel 38 is installed on an upper portion of the drying vessel 38. Further, an air-tight cover 37 is attached to the insufficiently-dried article providing port 36 and a bag filter 34 is connected to the exhaust port 310. Furthermore, a exhausting port 39 for taking out a dried article is installed in a lower portion of the dryer.

Further, as shown in FIG. 3, a jacket 31 is installed around said drying vessel 38 for preferably controlling a temperature inside the drying vessel 38 thereby enabling drying to be performed at a desired temperature. For that reason, a gap is formed between an outer wall of the drying vessel 38 and an inner wall of the jacket 31 such that a mixing operation can be conducted with cooling or heating by allowing heating steam or cooling water to flow in this gap.

Furthermore, when vacuum drying is performed while supplying a gas, such supply of the gas into the inside of the drying vessel 38 is conducted from a gas providing port 35 installed in a lower portion of an apparatus. By performing the vacuum drying with supplying the gas in a way as described above, blocking of the unrefined colored particles which is likely to be generated in the apparatus at the lower portion thereof is prevented and also evaporation of a volatile components such as adhesive moisture and an unreacted monomer from a surface of unrefined colored particles in a wet state can efficiently be performed. The gas supplied in the vessel 38 forms a new gas together with volatile components to be generated from the unrefined colored particles in a wet state and, then, the thus-newly formed gas is exhausted via the bag filter 34. After the gas containing volatile components is exhausted, it is sent into a condenser 33 in which it is condensed to produce a liquid made up with condensed water and the like and, then, the thus-produced liquid is exhausted from the condenser 33 as waste water.

A dryer shown in FIG. 4 is constituted such that a ribbon blade 311 which has a double spiral structure is allowed to be rotated on an upper portion of the drying vessel 38 in inverted conical form. By taking such a constitution, the unrefined colored particles supplied into the drying vessel 39 are repeatedly subjected to agitation and dispersion while they are lifted upward whereupon the un-dried unrefined colored particles in the drying vessel 38 can efficiently be agitated as a whole.

In the process P2, the transfer ratio R is expressed as R=X*Y/Z, when a transfer flowing quantity of the agitating blade is denoted by X [$m^3$/Hr]; a drying time is denoted by Y [Hr]; and a provided volume quantity of the unrefined colored particles in a wet state is denoted by Z [$m^3$]. The transfer flowing quantity X of the agitating blade is expressed as X=Vmin*Re*60, where a minimum volume per pitch of the agitating blade is denoted by Vmin [$m^3$] and a number of revolutions is denoted by Re [rpm]. The minimum volume per pitch of the agitating blade Vmin [$m^3$] is determined in accordance with a shape of the agitating blade of the vacuum dryer. For an example, in case that the agitating blade is of a screw type, the minimum volume is expressed by the following numerical expression: $Vmin=(d_1^2-d_2^2)/4*\pi*Le$, where an outer diameter of a pitch of a screw is denoted by $d_1$ [m], an inner diameter thereof is denoted by $d_2$ [m] and a length per pitch is denoted by Le [m]. For another example, in case that the agitating blade is of a ribbon type, the minimum volume is determined as an average value, since length and the like of a ribbon blade vary depending on a position thereof in the drying vessel. Specifically, the minimum volume is expressed by the following numerical expression: Vmin=Wi*Lr*Hi, where a height of the unrefined colored particles which are packed and left in a still state is denoted by Hi [m], a length of the ribbon blade is denoted by Lr [m] and a width of the ribbon blade is denoted by Wi [m]. In said preferable process P2, vacuum drying is performed by adjusting an agitation condition such that the transfer ratio R comes to be in a range of preferably from 40 to 500, and more preferably from 80 to 270. When the transfer ratio R is too small, not only much time is consumed in drying, but also a large quantity of aggregates are likely to be generated in a dried product; therefore, this case is not favorable. On the other hand, when the transfer ratio R is too large, due to heat generation or an increase of shearing force to be caused by a high-speed revolution of the agitating blade, there is a tendency in which a particle diameter distribution of the dried product is deteriorated or an aggregate is generated in the dried product; therefore, this case is not favorable, either.

In said preferable process P2, the vacuum drying is performed by charging the unrefined colored particles in a wet state into a vessel and by reducing pressure in the vessel, where a boiling point or a sublimation point of a volatile component in the unrefined colored particles is decreased, the volatile component is evaporated or sublimated, the resultant vapor thereof is condensed by a condenser which is connected to the vessel and the resultant condensate is removed.

Pressure inside the dryer at the time of performing the vacuum drying is ordinarily from 0.1 kPa to 30 kPa, preferably from 0.2 kPa to 15 kPa and more preferably from 0.2 kPa to 10 kPa. When the pressure is too high, evaporation of the volatile component is decreased whereupon drying efficiency is deteriorated.

Further, at the time of performing the vacuum drying, a gas may be injected. As types of gases to be injected, illustrated are nonflammable gases such as an air, helium, nitrogen, and carbon dioxide for prevention of dust explosion; among these gases, when cost is taken into consideration, air and nitrogen are preferable and, particularly, nitrogen is preferable.

A quantity of the gas to be injected is in a range in which the pressure inside the vessel does not exceed said range to a great extent; specifically, the gas is injected in a range of from 60 Pa to 3 kPa and preferably from 120 Pa to 2 kPa in terms of pressure increase inside the vessel. Such injection may be conducted either intermittently or continuously.

A temperature of the jacket of the vacuum dryer is in a range of ordinarily from 20° C. to 80° C. and preferably from 25° C. to 60° C. When the temperature of the jacket is too high, heat-aggregation of the unrefined colored particles thereamong is likely to occur; this case is not favorable. When the temperature of the jacket is too low, a drying speed is lowered thereby deteriorating drying efficiency. The term "jacket temperature" used herein is intended to include a temperature of a heat generating body attached to a place around or inside the drying vessel for heating the inside of the drying vessel.

In said preferable process P2, it is preferable that a temperature adjustment means is provided also in the agitating shaft of the dryer. Specifically, a temperature adjustment is performed by allowing a heat medium to circulate in the agitating shaft. By providing the agitating shaft with the temperature adjustment means, heat can be transmitted also via the agitating shaft or the agitating blade whereupon drying of the unrefined colored particles can be promoted. The temperature adjustment is performed in a range of ordinarily from 20° C. to 80° C., and preferably from 25° C. to 60° C.

In said preferable process P2, a product temperature of the unrefined colored particles at the time of vacuum drying sometimes becomes important. Namely, according to the present invention, the product temperature is allowed to be preferably 50° C. or less, and more preferably 35° C. or less. When the product temperature becomes high, there is a tendency in which unrefined colored particles are aggregated or fusion-bonded thereamong. The term "product temperature" used herein is intended not to indicate a temperature of the drying vessel but to indicate a temperature of said unrefined colored particles themselves and, specifically, is measured by a thermometer or the like inserted into among unrefined colored particles provided in the dryer.

It is preferable that the unrefined colored particles in a wet state are preheated before being introduced into the vacuum dryer. A temperature for such preheating is in a range of from (Ts-40)° C. to (Ts-20)° C., and preferably from (Ts-35)° C. to (Ts-25)° C., where a starting temperature of melting measured by Koka-type flow tester is denoted by Ts(° C.). A heater to be used for such preheating may be a vacuum dryer with an agitating blade thereinside, a tank with a heating source such as a jacket or a coil externally or internally or the like.

In said preferable process P2, it is more preferable that the unrefined colored particles are added with fine particles (D) having a smaller particle diameter than that of the unrefined colored particles and, then, subjected to the vacuum drying. Timing of addition of fine particles (D) is not particularly limited, so long as the fine particles exist together with the unrefined colored particles while they are vacuum-dried; on this occasion, it is preferable that the fine particles (D) are added to the unrefined colored particles in a wet state having a moisture content of 60% or less, and preferably in a range of from 10% to 60% and, then, the resultant mixture is dried while it is agitated. When the unrefined colored particles in a wet state are obtained by the polymerization method denoted by 2) or the association method denoted by 3), after the unrefined colored particles in a wet state are rinsed and filtered, they are added with the fine particles (D) and, then, the resultant mixture of the unrefined colored particles and the fine particles (D) is dried while it is agitated.

As the fine particles (D), various types of organic fine particles, inorganic fine particles, or a combination thereof can be used. When hard fine particles (D) having a smaller average particle diameter than a volume average particle diameter (Dv) of the colored particles to be obtained are used, it is easy to separate the mixture, after they are subjected to a drying process, into the colored particles and the fine particles (D) by a classification operation; therefore, this occasion is preferable. An average particle diameter of the fine particles (D) is preferably 1 $\mu$m or less, more preferably 0.5 $\mu$m or less, and particularly preferably in a range of from 20 nm to 50 nm. As the organic fine particles, mentioned are various types of organic fine particles; such as fine particles of polymers that have been polymerized and granulated simultaneously by an emulsification polymerization method, a soap-free emulsification polymerization method, a wet type polymerization method such as non-aqueous dispersion polymerization method, a vapor phase method or the like or first polymerized by any one of said methods and, then, granulated, such as fine particles of styrene polymers, fine particles of acrylate polymers, fine particles of methacrylate polymers, fine particles of olefin polymers, fine particles of fluorine-containing polymers, fine particles of nitrogen-containing acrylate polymers, fine particles of nitrogen-containing methacrylate polymers, fine particles of silicone, fine particles of benzoguanamine resin, fine particles of melamine resin and the like; carbon black, graphite and the like. As the inorganic fine particles, mentioned are carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, diamond carborundum and the like; nitrides such as boron nitride, titanium nitride, zirconium nitride and the like; borides such as zirconium boride and the like; various types of oxides such as iron oxide, chromium oxide, calcium oxide, magnesium oxide, zinc oxide, copper oxide, titanium oxide, tin oxide, alumina, silica and the like; sulfides such as molybdenum disulfide and the like; fluorides such as carbon fluoride and the like; metallic soap such as aluminum stearate, calcium stearate, zinc stearate, magnesium stearate and the like; various types of non-magnetic inorganic fine particles such as talc, bentonite and the like; and the like. It is preferable that surfaces of these organic fine particles or inorganic fine particles are subjected to a surface treatment by, for example, a silane coupling agent, a titanium coupling agent, silicone oil, and modified silicone oil. Among these surface-treated organic fine particles, surface-treated silica fine particles such as silica fine particles that have been subjected to a treatment for imparting hydrophobicity are particularly favorable.

Fine particles (D) are added in a ratio of ordinarily from 0.01 part by weight to 1.5 part by weight, preferably from 0.02 part by weight to 1.0 part by weight, and more preferably from 0.03 part by weight to 0.5 part by weight, based on 100 parts by weight (in terms of solid content basis) of the unrefined colored particles in a wet state. When a quantity of the fine particles (D) to be added is too small, aggregation prevention effect of the unrefined colored particles in the process P2 becomes small and, further, flowability enhancement effect of the unrefined colored particles after dried also becomes small. When the quantity of the fine particles (D) to be added is too large, after the unrefined colored particles are dried, over-flowability of the colored particles is occurred in the process P3 whereupon they tends to be spilled out of a line at a production process. The fine particles (D) can first be added to the unrefined colored particles and, then, be dried or the fine particles (D) may be added to the unrefined colored particles while the latter are dried. Further, an addition of the fine particles (D) in the process P2 generates a favorable effect also in the process P3. The fine particles (D) added in the process P2 remain in the unrefined colored particles still in the process P3 whereupon there is an effect of preventing the unrefined colored particles from being aggregated in the process P3. When the quantity of the fine particles (D) to be added is too smaller than the above range, the aggregation prevention effect also in the process P3 is small and, further, the flowability enhancement effect of colored polymer particles becomes small. When the quantity of the fine particles (D) to be added is too larger than the above range, over-flowability of the unrefined colored particles is generated in the process P3 whereupon there is a case in which the colored particles are spilled out of the line or the fine particles (D) cause a screen clogging; therefore, this case has a tendency of deteriorating a yield in the process P3. As described above, it is preferable that the fine particles (D) are added in the process P2. However, when the fine particles (D) are not used in the process P2, the fine particles (D) may be added to the unrefined colored particles in the halfway of from the process P2 to the process P3. Further, even when the fine particles (D) are used in the process P2, they may be added to the unrefined colored particles in an incremental manner in the halfway of from the process P2 to the process P3.

It is preferable that drying of the unrefined colored particles is performed until electric conductivity $\sigma 2$ of the unrefined colored particles and the colored particles after dried comes to be ordinarily 20 $\mu$S/cm or less, and preferably 15 $\mu$S/cm or less and $\sigma 2$-$\sigma 1$ comes to be ordinarily 10 $\mu$S/cm or less, and preferably 5 $\mu$S/cm or less. On this occasion, $\sigma 1$ represents electric conductivity of water that is ordinarily in a range of from 0 $\mu$S/cm to 15 $\mu$S/cm. The electric conductivity $\sigma 2$ is a value obtained by the steps of dispersing 6 g of the unrefined colored particles or the colored particles after dried into 100 g of ion-exchanged water, whose electric conductivity is $\sigma 1$, to obtain a dispersion liquid, boiling the thus-obtained dispersion liquid for 10 minutes, adding another ion-exchanged water previously boiled for 10 minutes to the thus-boiled dispersion liquid to recover a volume before being subjected to such boiling, cooling the resultant dispersion liquid down to room temperature and measuring the thus-cooled dispersion liquid by a conductance meter. When the $\sigma 2$ is too large, dependence of a charge amount of the toner to be obtained to an environment thereof becomes high whereupon deterioration of image quality of the electrophotograph is brought about by an environmental change (change of temperature or moisture).

In any of 1) the crushing method, 2) the polymerization method, 3) the association method and 4) the phase inversion emulsification method, the colored particles (unrefined colored particles) to be obtained may be subjected to the mixing process P4 by a mixer as they are but together with an outer-additive. However, since these unrefined colored particles contain large-size particles in many cases, it is preferable that the large-size particles are removed in advance (in the process P3), before they are subjected to the process P4. The reason for such preference is that, by removing the coarse particles (large-size particles) than a particle diameter range to be targeted, when the toner to be obtained is used in development of the electrophotograph, the image defect such as filming or a blank area can be eliminated.

Ordinarily, a process for removing coarse particles (large-size particles) and small particles (fine particles) than a particle diameter range to be targeted is called as "classification". In the process P3, the classification is ordinarily performed by using a wind force. As the classification by using the wind force, there are a method in which a force in a direction different from air flow direction is allowed to act on particles dispersed in the air flow and the classification is performed by making use of a difference in moving distances of particles and a method in which the classification is performed by making use of a difference in sedimentation rates of particles; on this occasion, classifiers making use of these methods such as a gravity classifier, an inertia classifier and a centrifugal classifier can be utilized.

It is preferable that the process P3 is a process of supplying the unrefined colored particles to a screen having an opening of from 5 $\mu$m to 40 $\mu$m to allow them to pass through it by using an air flow and removing large-size particles therefrom. The reason for such preference is that, when development of the electrophotograph is performed by using the toner to be obtained by being subjected to said process, the image defect such as the filming or the blank area is not generated whereupon such a process is low in cost, gives a high yield and is easy to set an operational condition and the like. When a particle diameter of the colored particles to be obtained is 7 μm or less in terms of the volume average particle diameter (Dv), it is particularly preferable to adopt said preferable process P3. The reason for such preference is that it can remove the large-size particles with a high yield compared with other processes.

In said preferable process P3, the screen to be used is such that has an opening in a range of preferably from 5 μm to 40 μm, and more preferably from 10 μm to 30 μm. By setting the opening of the screen to be the above range, the large-size particles in the colored particles can be removed with a high precision. When the opening of the screen is too large, the large-size particles in the colored particles can not be removed with a high precision and, when the development of the electrophotograph is performed by using the toner to be obtained by using such colored particles, the image defect such as the white streak is likely to be generated.

Examples of wires to be used in forming the screen include a metal such as stainless steel, a resin such as a polyamide and a polyester, but the wire is not particularly limited. Among wires, that which has been subjected to an antistatic treatment is preferable. Examples of methods of weaving the screen include plain weaving and twill weaving, but the method is not particularly limited.

In said preferable process P3, it is more preferable that a second screen 2 having a larger opening than that of a first screen 1 (from 5 μm to 45 μm) is arranged behind the first screen 1 (on a surface thereof in a downstream side of the air flow) in a state of tight contact with the first screen 1. The reason for such preference is that it is possible to enhance an endurance force of the first screen 1 thereby enabling it to be used for a long period of time. The opening of the second screen 2 which is in tight contact with the first screen 1 is not particularly limited so long as it is larger than that of the first screen 1, but is preferably in a range of from 200 μm to 2 mm.

In said preferable process 3, removal of the large-size particles is performed while a pressure difference between surfaces of the screen in downstream and upstream sides of said air flow is allowed to be preferably 3.5 kPa or less, and more preferably 3.0 kPa or less. By allowing the pressure difference between in an upstream side and in downstream side of the screen to be in the above range, clogging of the screen hardly occurs whereupon the large-size particles can efficiently be removed.

Figure 5:
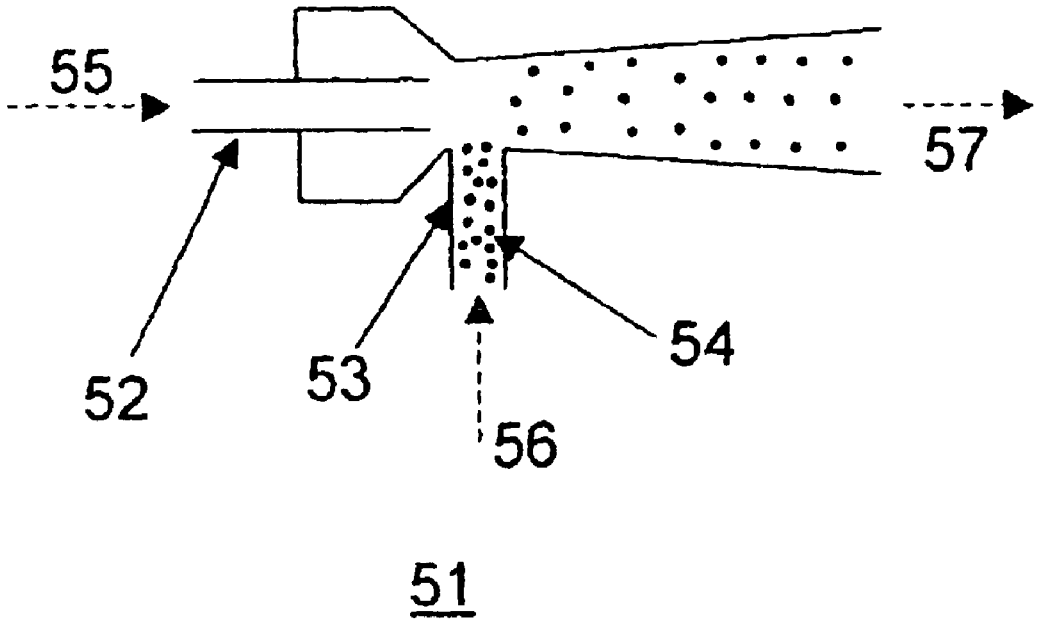
FIG. 5 is a schematic diagram showing an example of an ejector capable of being used in a process P3.

In said preferable process P3, it is preferable that the colored particles are supplied in a dispersed manner via an ejector. FIG. 5 shows a schematic diagram of the ejector that is described in detail below. The term "ejector" used herein is intended to include a dispersing apparatus which blows out an compressed air from an air blowout nozzle 52 to partially produce a vacuum therein, sucks in powder fluid 54 from a powder fluid suction nozzle 53, disperses the thus-sucked in powder fluid 54 and supplies the thus-dispersed powder fluid 54. Specifically, the apparatus has a constitution of the ejector 51 as shown in FIG. 5. By using the ejector, it is possible to supply the colored particles to the screen in a uniform manner and also to extend a service life of the screen.

In said preferable process P3, it is more preferable that the air flow which is allowed to pass through the screen is in a range of from 50 [m/min] to 100 [m/min] in terms of linear velocity. By setting the linear velocity of the air flow to be in this range, it is possible to extend the service life of the screen.

In said preferable process P3, density De of the colored particles is in a range of more preferably from 100 [g/m$^3$] to 500 [g/m$^3$], and particularly preferably from 180 [g/m$^3$] to 450 [g/m$^3$]. When the density De of the colored particles is too large, a yield of the colored particles which pass through the screen tends to be deteriorated, or breakage of the screen is likely to occur. On this occasion, the following numerical expression is established: De=V/W [g/m$^3$], in which V [g/min] represents a supply speed of the colored particles; and W [m$^3$/min] represents an volume rate of the air flow.

In said preferable process P3, an apparatus to remove the large-size particles which are present in the colored particles by using the screen is not limited to any particular type, but is more preferably an air sieve which can introduce the colored particles in a vertical direction against the screen. Example of such air sieves includes Hivolter (available from Shin-Tokyo Kikai).

The volume average particle diameter (Dv) of the colored particles to be obtained in the process P3 and to be used in the process P4 is not limited to any particular value, but is in a range of ordinarily from 2 μm to 10 μm, preferably from 2 μm to 9 μm, and more preferably from 3 μm to 8 μm. Further, a ratio of volume average particle diameter (dv)/number average particle diameter (Dp) is not particularly limited, but is in a range of ordinarily 1.7 or less, preferably 1.5 or less, and more preferably 1.3 or less. Colored particles having a particle diameter of 12.7 μm or more are preferably 3% by volume or less, and more preferably 2% by volume or less. When the colored particles having a particle diameter of 12.7 μm or more are too large in number, a white streak sometimes occurs in the electrophotograph developed by using the toner to be obtained. Further, it is preferable that the colored particles having a particle diameter range of from 2 μm to 4 μm are in a range of from 3% by number to 8% by number; and those having a particle diameter range of from 4 μm to 5 μm are in a range of from 5% by number to 12% by number. When the colored particles having a particle diameter range of from 2 μm to 4 μm are too small in number, resolution of the toner to be obtained sometimes is deteriorated; on the other hand, when they are too large in number, flowability of the toner to be obtained is deteriorated thereby sometimes causing fog in a developed electrophotograph. When the colored particles having a particle diameter range of from 4 μm to 5 μm are too small in number, resolution of the toner to be obtained is sometimes deteriorated; on the other hand, when they are too large in number, flowability of the toner to be obtained is deteriorated thereby sometimes causing fog in a developed electrophotograph. Further, it is preferable that the colored particles are in a range of from 1 to 1.3 in terms of sphericity and substantially spherical. The reason for such preference is that transferability of the toner to be obtained in development of the electrophotograph is enhanced. On this occasion, the sphericity is expressed by Sc/Sr, wherein Sc represents a surface area of a circle in which an absolute maximum length of the colored particles is designated as a diameter thereof; and Sr represents a substantial projected surface area of the particles.

The toner can be obtained by mixing the colored particles and an outer-additive by means of a mixer (process P4). According to the present invention, the process P4 denotes a process of mixing the colored particles and the outer-additive by a mixer with an agitating blade whose shaft portion is sealed by a gas having a flowing quantity of from 0.4 m$^3$/hr to 3 m$^3$/hr and which rotates at such a high speed as a peripheral speed at a tip thereof being from 20 m/sec to 50 m/sec. By adopting such a process, it becomes possible to allow the outer-additive to be firmly adhered to or partially embedded in the colored particles whereupon a yield after the colored particles and the outer-additive are mixed with one another is high, aggregates are small in number; therefore, when the toner to be obtained is used in development of the electrophotograph, an image having little white streak and fog can be obtained.

A flowing quantity of a gas which seals the shaft portion of the agitating blade of the mixer is in a range of ordinarily from 0.4 $m^3$/hr to 3 $m^3$/hr and preferably from 0.6 $m^3$/hr to 1.5 $m^3$/hr and a peripheral speed at a tip of the agitating blade is in a range of ordinarily from 20 m/sec to 50 m/sec, preferably from 30 m/sec to 48 m/sec, and more preferably from 35 m/sec to 45 m/sec. When the flowing quantity of the gas which seals the shaft portion is too small, the colored particles, the toner or a mixture thereof enters into a bearing of the shaft of the agitating blade and, then, is knelt therein whereby an aggregate of the toner, an aggregate of the colored particles, or an aggregate of a mixture of the toner and the colored particles is generated; such a case tends to cause a white streak in development of the electrophotograph by using the toner to be obtained. On the other hand, when the flowing quantity of the gas which seals the shaft portion is too large, since such a sealing gas enters into the colored particles to decrease an apparent density of the colored particles, numbers of colored particles and outer-additive which collide with the agitating blade are decreased whereupon the aggregate of the outer-additive becomes hard to be crushed and, as a result, when the toner to be obtained is used in development of the electrophotograph, the white streak becomes easily generated, or since the outer-additive becomes difficult to be sufficiently adhered to or partially embedded in the colored particles, when the toner to be obtained is used in development of the electrophotograph, the fog tends to be generated more as a number of printed sheets is increased. Further, the colored particles, the toner or the mixture thereof is exhausted outside the mixer together with the sealing gas and, thereby, the yield of the toner is deteriorated.

As another case, when the peripheral speed at the tip of the agitating blade is too slow, since agitation can not sufficiently be performed, the outer-additive is not sufficiently crushed whereupon, when the toner to be obtained is used for development of producing the electrophotograph, the white streak becomes easily generated, or since the outer-additive becomes difficult to be sufficiently adhered to or partially embedded in the colored particles, when the toner to be obtained is used in development of the electrophotograph, the fog tends to be generated more as a number of printed sheets is increased. To contrast, when the peripheral speed is too fast, agitating force in the process P4 becomes too strong and, as a result, the outer-additive tends to be filly embedded in the colored particles, flowability of the toner to be obtained is decreased whereupon, when the toner to be obtained is used in development of the electrophotograph, the fog tends to be generated more as a number of printed sheets is increased.

In the process P4, a temperature of the colored particles and the toner in the mixer is in a range of ordinarily from 20° C. to 50° C., preferably from 20° C. to 45° C., and more preferably from 20° C. to 40° C. When the temperature is too low, since the color particles become hard, the outer-additive sometimes becomes difficult to be adhered to or partially embedded in the colored particles. On the other hand, when the temperature is too high, since the colored particles become soft, the outer-additive is sometimes fully embedded in the colored particles. In either case, the flowability of the toner to be obtained is decreased and, when such a toner is used in development of the electrophotograph, the fog tends to be generated more as a number of printed sheets is increased.

In the process P4, the mixer to be used is not particularly limited so long as the shaft portion thereof can be sealed by a gas, the agitating blade installed therein can rotate at a high speed and the entire vessel can be cooled or heated. Examples of mixers that satisfy such requirements include a Henschel mixer (available from Mitsui Mining Co.) and Supermixer (available from Kawata Mfg. Co., Ltd.).

The gas for use in sealing the shaft portion is not particularly limited, but rare gasses such as helium and argon, nitrogen, dry air and the like can be used.

In the process P4, a quantity of the colored particles per unit inner volume inside said mixer is allowed to be in a range of preferably from 0.05 kg/liter to 0.4 kg/liter, and more preferably from 0.1 kg/liter to 0.3 kg/liter. When such a value is too low, productivity of the toner is deteriorated; on the other hand, when the value is too high, the colored particles, the toner, or a mixture thereof is exhausted outside the mixer and, thereby, a yield of the toner is sometimes deteriorated.

Further, in the process P4, a ratio between the colored particles and the outer-additive is not particularly limited, but the outer-additive is in a range of ordinarily from 0.1 part to 6 parts, preferably from 0.3 part to 5 parts, and more preferably from 0.5 part to 3 parts, by weight based on 100 parts by weight of the colored particles.

A preferable outer-additive according to the present invention contains silica fine particles (A) having an average particle diameter of a primary particle of from 5 nm to 18 nm, and preferably from 7 nm to 16 nm. A more preferable outer-additive further contains organic or inorganic fine particles (C) having an average particle diameter of a primary particle of from 0.1 $\mu$m to 1 $\mu$m, and preferably from 0.2 $\mu$m to 0.8 $\mu$m. A particularly preferable outer-additive still further contains silica fine particles (B) having an average particle diameter of a primary particle of from 20 nm to 60 nm, and preferably from 25 nm to 50 nm. Under the presence of these fine particles (A), (B) or (C), by making the outer-additive to be adhered to or partially embedded in a surface of the colored particles, characteristics such as chargeability, flowability, and shelf stability of the toner to be obtained can be adjusted.

In regard to the silica fine particles (A), when an average particle diameter thereof is too small, a photosensitive body to be used at the time of development of the electrophotograph tends to cause filming; on the other hand, when it is too high, flowability of the toner to be obtained is decreased whereupon, when the development of the electrophotograph is performed by using such a toner, a printing density therein tends to be partially deficient. In regard to the silica fine particles (B), when an average particle diameter thereof is too small, a photosensitive body to be used at the time of performing development for the electrophotograph tends to cause filming; on the other hand, when it is too high, flowability of the toner to be obtained is deteriorated whereupon, when the development of the electrophotograph is performed by using such a toner, a printing density therein tends to be partially deficient. In regard to the organic or inorganic fine particles (C), when an average particle diameter thereof is too small, at the time of using the toner to be obtained in development of the electrophotograph, its property to polish a photosensitive body is deteriorated; on the other hand, when it is too large, flowability of the toner to be obtained sometimes tends to be decreased.

These silica fine particles (A) or (B) are not particularly limited, but it is preferable that these silica fine particles (A) or (B) have been subjected to a treatment for imparting hydrophobicity in advance. The silica fine particles which have been subjected to a treatment for imparting hydrophobicity may be obtained from the market and used, or silica fine particles which are ordinarily available in the market may be treated in advance with a silane coupling agent, silicone oil or the like so as to impart them with a hydrophobic property.

As a treating method for imparting hydrophobicity, there are two methods as described below. A first method is that, while fine particles to be treated are agitated at a high speed, a treating agent such as a silane coupling agent or a silicone oil is dropped or sprayed to the fine particles. On this occasion, the treating agent may be diluted with an organic solvent or the like and, then, used. The other method is that a treating agent is dissolved in an organic solvent and, then, said fine particles are added to the resultant solution while it is agitated and, the thus-prepared mixture is subjected to a heat treatment.

An extent of imparting hydrophobicity is not particularly limited, but hydrophobicity degree determined by a methanol method is in a range of ordinarily from 20% to 90% and preferably from 40% to 80%. When the hydrophobicity degree is too low, the toner to be obtained tends to absorb moisture in a high humidity circumstance; on the other hand, when it is too high, at the time of using the toner to be obtained in development of the electrophotograph, its property to polish the photosensitive body is deteriorated; this case is sometimes not satisfactory.

The organic fine particles are not particularly limited so long as a number average particle diameter thereof is in a range of from 0.1 $\mu$m to 1 $\mu$m; however, a glass transition temperature or a melting point of a compound which constitutes the organic fine particles is in a range of ordinarily from 80° C. to 250° C., and preferably from 90° C. to 200° C. The reason for such preference is that the organic fine particles can be prevented from forming a blocking thereamong. Examples of such compounds that constitute the organic fine particles include homopolymers and copolymers of methacrylic acid esters such as a methyl methacrylate polymer and a styrene-methyl methacrylate copolymer. Further, it is preferable that the organic fine particles are in a range of from 1 to 1.3 and preferably from 1 to 1.2 in terms of sphericity, and they are substantially spherical fine particles. When the sphericity thereof is too large, the transferability of the toner to be obtained is sometimes deteriorated. On this occasion, the sphericity is expressed by Sc/Sr, in which Sc represents a surface area of a circle whose diameter is set to be an absolute maximum length of the organic fine particles; and Sr represents a substantial projected surface area of the organic fine particles.

The inorganic fine particles are not particularly limited so long as a number average particle diameter thereof is in a range of from 0.1 $\mu$m to 1 $\mu$m. As specific examples thereof, mentioned are silica, titanium oxide, aluminum oxide, zinc oxide, tin oxide, barium titanate, strontium titanate, these compounds whose surfaces have been treated with tin or antimony to impart them with electric conductivity, and the like, each of which has a set number average particle diameter.

A quantity of the silica fine particles (A) to be added is not particularly limited, but is in a range of ordinarily from 0.1 part to 3 parts, and preferably from 0.2 part to 2 parts, by weight based on 100 parts by weight of the colored particles. When it is too small, flowability of the toner to be obtained is deteriorated whereupon, when such toner is used in development of the electrophotograph, thinning is sometimes generated therein; on the other hand, when it is too large, the flowability of the toner to be obtained is heightened whereupon, when such toner is used in development of the electrophotograph, fog sometimes tends to be generated therein.

A quantity of the silica fine particles (B) to be added is not particularly limited, but is in a range of ordinarily from 0.1 part to 1 part, and preferably from 0.2 part to 0.7 part, by weight based on 100 parts by weight of the colored particles. When it is too small, at the time of using such toner to be obtained in development of the electrophotograph, its property to polish a photosensitive body is deteriorated whereupon filming is sometimes generated in an image. On the other hand, when it is too large, the flowability of the toner to be obtained is deteriorated whereupon, when such toner is used in development of the electrophotograph, a blank area sometimes tends to be generated therein.

A quantity of the organic fine particles and the inorganic fine particles (C) to be added is not particularly limited, but is in a range of ordinarily from 0.1 part to 2 parts, and preferably from 0.2 part to 1 part, by weight based on 100 parts by weight of the colored particles. When it is too small, at the time of using such toner to be obtained in development of the electrophotograph, filming is sometimes generated. On the other hand, when it is too large, the flowability of the toner to be obtained is deteriorated whereupon, when such toner is used in development of the electrophotograph, thinning is sometimes likely to be generated therein.

In regard to the toner to be obtained according to the prevent invention, volumetric specific resistance (log (Ω·cm)) measured by a dielectric loss measuring device is in a range of ordinarily from 10 to 13, and preferably from 10.5 to 12.5. When the volumetric specific resistance is too small, at the time of development of the electrophotograph, fog sometimes occurs; on the other hand, when it is too large, at the time of development of the electrophotograph, insufficient cleaning sometimes occurs.

In regard to the toner to be obtained according to the present invention, a softening temperature (hereinafter referred to Ts when appropriate) is in a range of ordinarily from 50° C. to 80° C. and preferably from 60° C. to 70° C., and a temperature at the beginning of flowing (hereinafter referred to TFb when appropriate) is in a range of ordinarily from 90° C. to 150° C. and preferably from 100° C. to 130° C., wherein both temperatures are measured by a Koka-type flow tester. When the softening temperature is too low, shelf stability is sometimes deteriorated; on the other hand, when it is too high, at the time of development of the electrophotograph, a fixing property is sometimes deteriorated. When the temperature at the beginning of flowing is too low, at the time of development of the electrophotograph, a temperature at which a hot offset phenomenon occurs is sometimes lowered; on the other hand, when it is too high, a fixing property is sometimes deteriorated.

In regard to the toner to be obtained according to the present invention, a glass transition temperature measured by a differential scanning calorimetry (hereinafter referred to DSC when appropriate) is in a range of ordinarily from 20° C. to 80° C., and preferably from 40° C. to 60° C. When the glass transition temperature is too low, shelf stability is sometimes deteriorated; on the other hand, when it is too high, at the time of development of the electrophotograph, a fixing property is sometimes deteriorated.

In regard to the toner to be obtained according to the present invention, a volume average particle diameter (Dv) is in a range of ordinarily from 0.5 μm to 20 μm, preferably from 1 μm to 10 μm, and more preferably from 2 μm to 8 μm. When the particle diameter is too large, resolution of the electrophotograph to be obtained by performing development by using such a toner tends to be lowered; this case is not favorable. It is possible that said toner is used either as a one-component developing agent, or as a two-component developing agent prepared by being combined with an appropriate carrier.

EXAMPLES

A production method according to the present invention is described in detail below with reference to Examples, but the present invention is in no way limited thereto. Unless stated otherwise, all parts and percentages are given by weight.

Evaluation methods conducted in the present embodiments are described below.

Test T1: Volume Average Particle Diameter (Dv) and Particle Diameter Distribution A volume average particle diameter (Dv) and a particle diameter distribution of colored particles and unrefined colored particles were measured by using Multisizer (available from Beckman-Coulter Inc.). Under the name of the particle diameter distribution, there are items of a ratio (Dv/Dp) of the volume average particle diameter (Dv) to the number average particle diameter (Dp), a percentage (%) by volume of the colored particles each having a particle diameter of 12.7 μm or more, a percentage (%) by number of the colored particles each having a particle diameter of from 2 μm to 4 μm, and a percentage (%) by number of the colored particles each having a particle diameter of from 4 μm to 5 μm. Measuring conditions of Multisizer are as follows; aperture orifice: 100 μm; medium: Isotone II; concentration: 10%; and a number of measured particles: 100,000 pieces.

Test T2: Solid Content Concentration in a Filtrate of Dispersion Liquid of Unrefined Colored Particles In the process P1, 5 g of filtrate subjected to a solid-liquid separation is obtained and, after a weight of a piece of filter paper (under the trade name of "NO.2"; available from Toyo Roshi Kaisha, Ltd.) which has been dried in advance at 105° C. for 2 hours was precisely measured, the thus-obtained filtrate was filtered by using a vacuum filter. After being filtered, the filter paper with a solid content was dried at 105° C. for 2 hours and precisely measured. A solid content concentration in the filtrate was calculated by the following numerical expression:

Solid content concentration (%)=(weight of filter paper with solid content after being dried-weight of filter paper before used)/weight of filtrate *100

Test T3: Moisture Content of Filter Cake Obtained by Subjecting Dispersion Liquid of Unrefined Colored Particles to Solid-liquid Separation.

In the process P1, after a solid-liquid separation is performed, a filter cake is partially removed, and 2 g of the thus-removed filter cake was placed on an aluminum cup and precisely weighed ($W_0$[g]) and left to stand in a drier for 2 hours at 105° C. and, then, cooled and, thereafter, precisely weighed ($W_1$[g]). A moisture content of the filter cake was calculated by the following numerical expression:

Moisture content of filter cake (%)=$100*(W_0-W_1)/W_0$

Test T4: Filtration Speed of Dispersion Liquid of Unrefined Colored Particles

In the process P1, after 30 seconds passed from time that a dispersion liquid of unrefined colored particles started to be supplied to a solid-liquid separator, a filtrate was sampled for 30 seconds and, then, weight of the thus-sampled filtrate was measured ($W_2$). A filtration speed was calculated by the following numerical expression:

Filtration speed (kg/(m$^2$·hr))=$W_2$*120/surface area of filter of solid-liquid separator.

Test T5: Quantity of Large-size Particles in Unrefined Colored Particles

In the process P2, a quantity of large-size particles in unrefined colored particles obtained after drying was measured in such a manner as described below. 1,000 g of the obtained unrefined colored particles was weighed and, then, gradually supplied on a sieve made of stainless steel (opening: 325 mesh, 45 μm) and, thereafter, sieved while the toner was sucked from a reverse side of the sieve. An aggregate remaining on the sieve was rinsed with methanol and, then, dried together with the sieve and weighed together. The resultant weight was subtracted by the weight of the sieve which had previously been weighed to obtain a difference. The difference was designated as a quantity of large-size particles having a size of 45 μm or more (represented by W; unit being "g") and, then, the quantity of the large-size particles was calculated in accordance with the following numerical expression:

Quantity of large-size particles (% by weight)=(W/1,000)*100.

Test T6: Sphericity of Colored Particles

In the process P3, sphericity of colored particles to be obtained was measured in such a manner as described below. An photograph of the colored particles was taken using an electron microscope and, then, a surface area of a circle (Sc) in which an absolute maximum length of the colored particles is designated as a diameter thereof and a substantial projected surface area (Sr) of particles were measured by using an image processing analyzer LUZEX IID (available from Nireco Corporation) with the thus-taken electron photograph, thereby a sphericity was calculated as a ratio therebetween (Sc/Sr). On this occasion, conditions of the analyzer are as follows; ratio of particle surface area against frame surface area: max. 2%; and total processed particle number: 100 pieces. The value of sphericity was obtained as an average value of 100 colored particles.

Test T7: Yield of Mixing Colored Particles and Outer-additive

In the process P4, total weight of colored particles and an outer-additive which have been provided into a mixer is designated as W1 while weight of such colored particles and outer-additive which have been provided into the mixer, mixed therein and, then, weight of the recovered is designated as W2. A yield of mixing was calculated in accordance with the following numerical expression:

Yield of mixing (%)=W2/W1*100(%).

Test T8: Quantity of Aggregate in Toner

A quantity of an aggregate that is present in the toner obtained in the process P4 was measured in such a manner as described below. 1,000 g of the obtained toner was weighed and, then, gradually supplied on a sieve made of stainless steel (opening: 325 mesh; 45 μm) and, thereafter, sieved while the toner was sucked from a reverse side of the sieve. The aggregate remaining on the sieve was rinsed with methanol and, then, the aggregate was dried together with the sieve and weighed together. The resultant weight was subtracted by weight of the sieve which had previously been weighed to obtain a difference. The difference was designated as a quantity of the aggregate having a size of 45 μm or more (represented by W; unit being "g") and, then, the quantity of the aggregate was calculated in accordance with the following numerical expression:

Quantity of aggregate of 45 μm or more (% by weight)=(W/1,000)*100.

Test T9: Softening Temperature and Temperature at the Beginning of Flowing of Toner A softening temperature and a temperature at the beginning of flowing of the toner obtained in the process P4 were measured in such a manner as described below. From 1 to 1.3 g of obtained toner was putted in a flow tester (CFT-500C; available from Shimadzu Corporation) and, then, the softening temperature (Ts) and the temperature at the beginning of flowing (TFb) of the toner were measured under the following conditions: temperature at the beginning of measurement: 35° C.; temperature raising speed: 3° C./min; preheating time: 5 min; cylinder pressure: 10 kgf/cm$^2$; diameter of die: 0.5 mm; length of die: 1.0 mm; and shear stress: 2.451*10$^5$ Pa.

Test T10: Glass Transition Temperature of Toner

A glass transition temperature of the toner obtained in the process P4 was measured in such a manner as described below. Such a temperature was measured by using a differential scanning calorimetry (SSC5200; available from Seiko Denshi Kogyo Co., Ltd.) in accordance with ASTM D3418-97. Sample: about 10 mg of toner which had been precisely weighed; vessel: a pan made of aluminum; reference: a vacant pan made of aluminum; measurement temperature range: from room temperature to 150° C.; temperature raising speed: 10° C./min.

Test T11: Fog

Fog that gives an influence on an image quality when the obtained toner is used in development of the electrophotograph was tested in such a manner as described below. A non-magnetic one-component developing type printer (printing speed: 16 sheets/min) which is commercially available was used as an electrophotograph developing machine. A toner which is a target to be tested was set on the printer and kept at 23° C., 50% RH for 24 hours to be stabilized. Thereafter, a continuous printing was performed at a printing density of 5% while using copy paper as a transfer material. During such printing, the printing density was measured by using a reflection densitometer (available from McBeth Co.) every 500 printed sheets whereupon whiteness of a non-image portion of the printed transfer paper was measured by using a whiteness meter (available from Nippon Denshoku K.K.). A total number of the printed sheets was 20,000. Whiteness X of an unprinted transfer material had been measured in advance, whiteness Y of the non-image portion of the printed transfer material was measured and, then, a number of printed sheets at the time a difference obtained by subtracting the measurement Y from the measurement X exceeds 1 was counted and the thus-counted number was designated as an indicator of the fog. A representation of ">20,000" shown in Table 1 signifies that, even when 20,000 sheets were continuously printed, no fog appeared thereon.

Test T12: White Streak

A white streak which gives an influence on an image quality when the obtained toner was used in development of the electrophotograph was tested in such a manner as described below. A printer of same type as in Test T12 was used as an electrophotograph developing machine. Stabilization was performed in a same manner as in Test T11. Thereafter, a continuous printing was performed at a printing density of 5% while using copy paper as a transfer material. Every 500 sheets, full solid printing was performed and, then, a number of printed sheets at the time a white streak appeared therein was counted. A total number of printed sheets was set to be 20,000 or 10,000, and the test in the former case is designated as T12$^{20,000}$ while the test in the latter case is designated as T12$^{10,000}$. In the test T12$^{20,000}$, the representation ">20,000" shown in Tables signifies that the total number of printed sheets is 20,000 and no white streak appeared even after 20,000 sheets were continuously printed. Further, in the test T12$^{10,000}$, the representation ">10,000" shown in Tables signifies that the total number of printed sheets is 10,000 and no white streak appeared even after 10,000 sheets were continuously printed.

Example 1

Preparation of Dispersion Liquid A of Unrefined Colored Particles

A polymerizable monomer for a core comprising 80.5 parts of styrene and 19.5 parts of n-butyl acrylate (Tg of a copolymer to be obtained by copolymerizing these monomers=55° C.), 0.3 part of a polymethacrylic acid ester macromonomer (under the trade name of "AA6"; available from Toagosei Chemical Industry Co., Ltd.; Tg=94° C.) as a macromonomer, 0.5 part of divinyl benzene as a crosslinkable monomer, 1.2 part of t-dodecyl mercaptan as a molecular weight control agent, 7 parts of carbon black (under the trade name of "#25B "; available from Mitsubishi Chemical Corporation) as a colorant, 1 part of a charge control agent (under the trade name of "Spiron Black TRH"; available from Hodogaya Chemical Co., Ltd.), and 10 parts of dipentaerythritol hexamyristate (endothermic peak temperature: 65° C.) as a parting agent were mixed and, then, subjected to wet-type crushing by using a media-type wet-crushing device to obtain a polymerizable monomer composition for a core.

On the other hand, an aqueous solution obtained by dissolving 6.2 parts of sodium hydroxide as an alkali metal hydroxide in 50 parts of ion-exchanged water was gradually added to an aqueous solution obtained by dissolving 10.2 parts of magnesium chloride as a water-soluble polyfunctional metallic salt in 250 parts of ion-exchanged water while stirring to prepare a dispersion liquid of magnesium hydroxide colloid which is water-hardly soluble metal hydroxide colloid. A particle diameter distribution of the thus-prepared colloid was measured by using a microtrack particle diameter distribution measuring device (available from Nikkiso Co., Ltd.), and, consequently, D50 (50% cumulative value of number particle diameter distribution) was 0.35 μm, and D90 (90% cumulative value of number particle diameter distribution) was 0.85 μm. These measurements were conducted under the following conditions; measuring range: from 0.12 μm to 704 μm; measuring time: 30 seconds; and medium: ion-exchanged water.

Further, 3 parts of methyl methacrylate (Tg of a polymer to be obtained by polymerizing this monomer=105° C.) was finely dispersed in 100 parts of water by using an ultrasonic emulsifier to obtain an aqueous dispersion liquid of a polymerizable monomer for a shell. A particle diameter of said droplet in a finely dispersed state of the polymerizable monomer for a shell was measured and D90 was 1.6 μm. This measurement was conducted by using the microtrack particle diameter distribution measuring device on a sample prepared by adding the thus-obtained droplet into 1% aqueous solution of sodium hexametaphosphate such that a density thereof becomes 3%.

Said polymerizable monomer composition for a core was added to said dispersion liquid of the magnesium hydroxide colloid and agitated until they do not perform a phase separation therebetween. To the resultant mixture, added was 6 parts of t-butyl peroxy-2-ethylhexanoate (under the trade name of "Perbutyl O"; available from NOF Corporation) as a polymerization initiator to obtain a mixture. The thus-obtained mixture was agitated at a revolution of 15,000 rpm for 30 minutes under high shear by using Ebara Milder as a granulating device to allow the droplet of the monomer composition to be granulated. The thus-prepared dispersion liquid of the obtained monomer mixture was provided into a reactor with an agitating blade, heated up to 85° C. while agitating to allow it to be polymerized. After polymerization conversion rate thereof reached approximately 100%, to a vessel containing the resultant polymerized mixture, provided was a mixture obtained by dissolving 0.3 part of 2,2'-azobis(2-methyl-N-(2-hydroxyethyl)-propionamide) (under the trade name of "VA-086"; available from Wako Jun-yaku Co., Ltd.) as a water-soluble polymerization initiator in an aqueous dispersion liquid of said polymerizable monomer for a shell. The mixture in the vessel was agitated to allow said polymerizable monomer for a shell to be polymerized continuously for 4 hours and, then, the reaction was terminated to obtain a dispersion liquid A of unrefined colored particles. A solid content concentration in the thus-obtained dispersion liquid A of the unrefined colored particles was 32%.

Process P1

Sulfuric acid was added to the dispersion liquid A of the unrefined colored particles until it becomes pH 6 or less to allow magnesium hydroxide on a surface of the unrefined colored particles to have a water-soluble property. The obtained dispersion liquid was provided to a continuous belt filter (under the trade name of "Eagle filter"; available from Sumitomo Heavy Industries, Ltd.) and dehydrated. A large quantity of ion-exchanged water (10 times weight of the remained solid content on a dry basis) was poured from an upper side of the solid content remained on the filter to rinse the solid content and, subsequently dehydrated. A moisture content (T3) of the resultant unrefined colored particles was 35% by weight. Ion-exchanged water was added to the unrefined colored particles in a cake state to allow them to be dispersed again and to be in a slurry state again thereby preparing a dispersion liquid of the unrefined colored particles having a solid content concentration of 20% by weight.

Next, the solid-liquid separation in the end of the process P1 was performed in such a manner as described below. As a filter material, a 5-layer laminated porous metallic body (under the trade name of "Fuji Plate"; available from Fuji Filter Mfg. Co., Ltd.; pore size: 2 $\mu$m; material: stainless steel) which had been produced by vacuum sintering was used and, as a solid-liquid separator, a basket type centrifugal filter system (under the trade name of "KM-20 Type"; available from Matsumoto Kikai Co., Ltd.) was used. Said filter material was fixed to said solid-liquid separator and, then, while a basket was rotated under a condition that a centrifugal effect comes to be of 500 G, 600 parts of the obtained dispersion liquid was supplied spending about 3 minutes. On this occasion, a solid content concentration (T2) of the filtrate was 0 ppm and leakage of the solid content into the filtrate was not noticed. After all of said dispersion liquid was supplied, the basket was rotated for 4 minutes under a condition that the centrifugal effect comes to be of 1200 G. Leaving 5 mm thick of solid content out of the entire solid content (unrefined colored particles in a wet state) generated in the basket, all other solid content was scraped out by using a filter cake scraping device. All of the thus-remained 5 mm thick solid content was collected from the filter material by using air blow. A moisture content (T3) of the thus-obtained unrefined colored particles A in a wet state was 12.9% by weight. Such a solid-liquid separation operation was repeated 20 times, but no reduction in filtration speed (T4) was noticed.

For a reference purpose only, a same operation as described above was conducted by using polypropylene filter cloth as a filter material (air permeability: two types of 60 cc/cm$^2$·min and 250 cc/cm$^2$·min) and, as a result, the solid content concentrations (T2) in the filtrate were 50 ppm and 850 ppm, respectively and, further, moisture contents of obtained unrefined colored particles in a wet state were 14.7% by weight and 13.1% by weight, respectively. When the solid-liquid operation was repeatedly performed, reductions of filtration speed (T4) by 10% compared with the initial filtration speed were noticed at 12th operation and 18th operation, respectively; on these occasions, changes of filter materials were necessary in both cases. When the 5-layer laminated porous metallic body which had been produced by vacuum sintering was used as the filter material, in comparison with the case in which the filter cloth made of polypropylene was used, it was found that leakage of the unrefined colored particles into the filtrate was not noticed, separation of the unrefined colored particles was efficiently performed and there was no need for such maintenance as change-over filter materials and the like.

Process P2

Said unrefined colored particles A in a wet state were dried in such a manner as described below. 0.1 part of hydrophobic silica (under the trade name of "R972"; average particle diameter: 16 nm; available from Nippon Aerosil Co., Ltd.) was added as fine particles (D) to 100 parts of the unrefined colored particles in a wet state (moisture content: 12.9%). Said unrefined colored particles in a wet state were provided in a tank under a normal pressure, heated at 35° C. to be preheated. The thus-preheated unrefined colored particles in a wet state were provided in a drying vessel of a vacuum dryer shown in FIG. 3 to be vacuum-dried. On this occasion, conditions are as follows: outer diameter $d_1$ of pitch of agitating blade of this dryer: 0.3 m; inner diameter $d_2$ of pitch thereof: 0.1 m; and length per pitch L: 0.25 m, whereupon a transfer ratio R was 110 (revolution of agitating blade: 62 rpm; drying time: 8 hours; provided powder volume: 4 m$^3$); pressure: 4 kPa; and jacket temperature: 50° C. A temperature of unrefined colored particles themselves was 30° C. all through the drying operation except that the temperature thereof was raised to 33° C. just before the drying operation was terminated. While drying is performed, a small portion of the unrefined colored particles was sampled out several times and a moisture content thereof was measured whereupon, when the moisture content thereof was noticed to be 0.3% or less, drying operation was stopped to obtain unrefined colored particles A. A quantity of large-size particles (T5) of the unrefined colored particles A was 0.1% by weight or less.

For a reference purpose only, drying tests were conducted by varying the transfer ratio R in various ways. When the transfer ratios R were 250, 185, 110 and 120, in any case, the quantity of the large-size particles (T5) was as little as 0.1% by weight or less whereas, when the transfer ratios 30 and 600, a quantity of large-size powders was increase to be 2% by weight and 3% by weight, respectively. When the transfer ratio R was in a range of from 40 to 500, a quantity of the large-size particles in the unrefined colored particles to be obtained was small; hence it is found that heat aggregation is not likely to occur in the process P2.

Process P3

The unrefined colored particles A obtained in the above process were classified by an Alpine type classifier (centrifugal type air flow classifier) to cut off a fine powder side, wherein revolution of the classifier was 16,000 rpm. Further, a large-size powder side was also cut off by said classifier to obtain colored particles A, wherein revolution of the classifier was 10,000 rpm. A yield (ratio of weight of colored particles to weight of unrefined colored particles) of this classifying process (P3) was 88.7%. In regard to the obtained colored particles, a particle diameter distribution (T1) thereof was measured. As a result, a volume average particle diameter Dv was 8.4 μm, a number average particle diameter Dp was 7.0 μm, and a ratio Dv/Dp was 1.22. The colored particles having a particle diameter of 12.7 μm or more were 1.2% by volume, the colored particles having a particle diameter range of from 2 μm to 4 μm was 6.3% by number and the colored particles having a particle diameter range of from 4 μm to 5 μm were 8.1% by number. Further, sphericity (T6) was 1.12.

Process P4

To 100 parts of the above-obtained colored particles A, added were 0.8 part of silica having an average particle diameter of 12 nm and a hydrophobicity of 65% (under the trade name "RX200"; available from Nippon Aerosil Co., Ltd.) as silica fine particles (A), 0.5 part of silica having an average particle diameter of 30 nm and a hydrophobicity of 63% (under the trade name "RX50"; available from Nippon Aerosil Co., Ltd.) as silica fine particles (B), and 0.3 part of styrene-methyl methacrylate copolymer particles having an average particle diameter of 0.3 μm and a sphericity of 1.12 as fine particles (C). The resultant mixture was mixed for 6 minutes by a Henschel mixer as a mixer with an agitating blade to obtain a toner. On this occasion, as a gas for sealing a shaft portion of the agitating blade, a dry air was used and a flowing quantity thereof was 1.0 $m^3$/hr, a peripheral speed at a tip of the agitating blade was 40 m/s, and a quantity of the colored particles per unit volume inside a mixing machine was 0.27 kg/l.

In regard to the obtained toner, various types of test were conducted. volumetric specific resistance (log Ω cm) thereof measured by a dielectric loss measuring device was 11.2; in Test T5, a softening temperature in the test T5 was 65° C. and a starting time of flowing was 116° C.; and a glass transition temperature in Test T10 was 55° C. Further, a development performance test (T11 and $T12^{20,000}$) of the toner was conducted. The obtained test results are summarized in Table 1.

Examples 2 to 5, and Comparative Examples 1 to 4

Unrefined colored particles A were used. By changing the classifying conditions in the process P3, colored particles having a particle diameter distribution shown in Table 1 were obtained. A toner was obtained in a same manner as in Example 1 except that colored particles shown in Table 1 was used, the flowing quantity of the gas which seals the shaft portion of the agitating blade and the spherical speed at the tip of the agitating blade were changed into those shown in Table 1. Test results are shown in Table 1.

From the results shown in Table 1, the facts as described below are found. The toner in Comparative Example 1, in which a flowing quantity of the gas which seals the shaft portion of the agitating blade is smaller than the range thereof of the present invention, has many aggregates and tends to generate a white streak. The toner in Comparative Example 2, in which flowing quantity of the gas which seals the shaft portion of the agitating blade is larger than the range thereof of the present invention, has a remarkably low yield. The toner in Comparative Example 3, in which the spherical speed at the tip of the agitating blade is slower than the range thereof of the present invention, has many aggregates and tends to generate a white streak and fog. The toner in Comparative Example 1, in which the spherical speed at the tip of the agitating blade is faster than the range thereof of the present invention, has many aggregates and tends to generate a white streak and fog.

To contrast, it is found that, in the production method according to the present invention, when the colored particles and the outer-additive are mixed, aggregates are not generated and the yield of the toner is high. Further, it is found that the toner according to the present invention can form the image having little white streak and fog.

Example 6 to Example 13

Preparation of Dispersion Liquid B of Unrefined Colored Particles

A dispersion liquid B of the unrefined colored particles was prepared in a same manner as in the dispersion liquid A of the unrefined colored particles except that 7 parts of carbon black (under the trade name of "#25"; available from Mitsubishi Chemical Corporation) was used as a colorant and 2 parts of Fischer-Tropsh wax (under the trade name of "Paraflint Spray 30"; endothermic peak temperature: 100° C.; available from Sasol Limited) was used as a parting agent. A solid content concentration of the dispersion liquid B of the obtained unrefined colored particles was 31%.

Process P1

The unrefined colored particles B in a wet state were obtained in a same manner as in Example 1 except that the dispersion liquid B of said unrefined colored particles was used as a dispersion liquid of the unrefined colored particles.

Process P2

The unrefined colored particles B were obtained in a same manner as in Example 1 except that said unrefined colored particles in a wet state B were used as the unrefined colored particles in a wet state and the fine particles D were not used in Example 11.

In regard to the particle diameter distribution of the above-obtained unrefined colored particles, the volume average particle diameter (Dv) thereof was 7.26 μm; the number average particle diameter (Dp) was 6.10 μm; the volume % of 16 μm or more was 1.6%; the volume % of 20 μm or more was 0.9%; and the number % of 5 μm or less was 24.1%.

Process P3

Large-size particles in these unrefined colored particles B were removed by using an air sieve(under the trade name of "Hivolter-NR-300 Type"; available from Shin-Tokyo Kikai). A screen having a diameter of 300 mm and an opening of each of 20 μm and 26 μm as shown in Table 2 was used; on this occasion, a wire material was stainless steel. A supply speed of the unrefined colored particles, a linear velocity of air flow, density De of colored polymer particles, and a difference in pressure of air flow between in an upstream side and in a downstream side of the screen are optionally varied in accordance with combinations shown in Table 2. A yield (ratio of weight of colored particles to weight of unrefined colored particles) in this process (P3) and the particle diameter distribution of the obtained colored particles are shown in Table 2.

Process P4

A toner was obtained in a same manner as in Example 1 except that the above-obtained colored particles were used as colored particles, and 0.6 part of silica having an average particle diameter of 7 nm and a hydrophobicity of 65% (under the trade name of "RX300"; available from Nippon Aerosil Co., Ltd.) was used as silica fine particles (A).

In regard to the thus-obtained toner, the white streak test $T12^{10,000}$ was conducted as a performance test at the time of development of the electrophotograph. The results are shown in Table 2.

From the results shown in Table 2, the facts as described below are found. In Examples 6 to 13, at the process P3, a screen having an opening in a range of from 5 μm to 40 μm was used and a process which performs classification by air flow was adopted. For these features, the results of Examples 6 to 13 are excellent in the yield in the process P3 compared with the case in Example 1 (centrifugal type air flow classifier being used). Further, in Example 6 and Example 8, an ejector was used. In these cases, even when the supply speed of the colored particles at the process P3 is allowed to be increased, a pressure difference between in the upstream side and in the downstream side of the screen is not increased whereupon, since the yield in the process P3 is not decreased, production efficiency of the colored particles is favorable. It is found that the toner obtained as a result of Examples 6 to 13 can form an image having little white streak.

INDUSTRIAL APPLICABILITY

According to the present invention, a method for producing a toner that is high in yield after colored particles and an outer-additive are mixed and which is small in quantity of aggregates is provided. When the toner to be obtained according to the present invention is used in development of an electrophotograph, an image having little white streak can be formed. The toner to be obtained according to the present invention can advantageously be used in development of the electrophotograph in a copying machine, a printer and the like.

TABLE 1

Summary of Examples 1 to 5 and Comparative Examples 1 to 4

| | Examples | | | | | Comparative Examples | | | |
|---|---|---|---|---|---|---|---|---|---|
| | 1 | 2 | 3 | 4 | 5 | 1 | 2 | 3 | 4 |
| Particle diameter distribution of colored particles (T1) | | | | | | | | | |
| Particles of 12.7 μm or more (% by volume) | 1.2 | 1.8 | 1.2 | 1.8 | 2.5 | 1.2 | 1.8 | 1.2 | 1.8 |
| Particles of 2 to 4 μm (% by number) | 6.3 | 4.2 | 6.3 | 4.2 | 10.7 | 6.3 | 4.2 | 6.3 | 4.2 |
| Particles of 4 to 5 μm (% by number) | 8.1 | 6.5 | 8.1 | 6.5 | 14.4 | 8.1 | 6.5 | 8.1 | 6.5 |
| Mixing conditions | | | | | | | | | |
| Gas flowing quantity of shaft portion ($m^3$/hr) | 1 | 1.3 | 0.7 | 2.5 | 1 | 0.2 | 3.5 | 1 | 1 |
| Peripheral speed at agitating blade tip (m/s) | 40 | 36 | 30 | 40 | 40 | 40 | 40 | 15 | 60 |
| Yield of mixing (%) (T7) | 99.2 | 98.6 | 98.7 | 92.3 | 99 | 99.2 | 82.5 | 98.3 | 90.5 |
| Aggregate quantity (%) (T8) | 0.003 | 0.001 | 0.04 | 0.03 | 0.002 | 0.43 | 0.07 | 0.26 | 0.16 |
| Development performance | | | | | | | | | |
| White streak ($T12^{20,000}$) | >20,000 | >20,000 | 12,500 | 10,000 | >20,000 | 4,000 | 11,500 | 5,500 | 8000 |
| Fog ($T11^{20,000}$) | >20,000 | >20,000 | >20,000 | >20,000 | 12,000 | >20,000 | 15,500 | 6,000 | 9,500 |

TABLE 2

Summary of results of Examples 6 to 13

| | | Example 6 | Example 7 | Example 8 | Example 9 | Example 10 | Example 11 | Example 12 | Example 13 |
|---|---|---|---|---|---|---|---|---|---|
| Process P2 | Quantity of fine particles (D) to be added [parts by weight] | 0.05 | 0.05 | 0.05 | 0.05 | 0.05 | none | 0.05 | 0.05 |
| Process P3 | Opening of screen [μm] | 20 | 20 | 20 | 20 | 20 | 20 | 26 | 20 |
| | Quantity of gas to be sucked by blower [$Nm^3$/min] | 5.5 | 4 | 6.0 | 5.5 | 5.5 | 5.5 | 5.5 | 5.5 |
| | Supply speed of unrefined colored particles [kg/hr] | 70 | 70 | 70 | 100 | 140 | 70 | 70 | 140 |
| | Linear velocity of air flow [m/min] | 79 | 57 | 86 | 79 | 79 | 79 | 79 | 79 |
| | Density De of unrefined colored particles [g/$m^3$] | 212 | 292 | 194 | 303 | 424 | 212 | 212 | 424 |
| | Presence or absence of ejector | absence | absence | absence | absence | absence | presence | absence | presence |
| | Pressure difference on surfaces of screen [kPa] | 1.2 | 1.0 | 1.2 | 2.3 | 3.0 | 1.0 | 1.0 | 1.3 |
| | Yield in the process P3 (%) | 98.7 | 98.5 | 98.9 | 98.8 | 98.5 | 98.9 | 99.3 | 99.2 |
| Particle diameter distribution of colored particle (T1) | | | | | | | | | |
| Volume average particle diameter [μm] | | 7.24 | 7.23 | 7.25 | 7.23 | 7.27 | 7.22 | 7.28 | 7.26 |
| Number average particle diameter [μm] | | 6.09 | 6.10 | 6.09 | 6.08 | 6.08 | 6.07 | 6.12 | 6.10 |
| Volume % of 16 μm or more [%] | | 0.11 | 0.23 | 0.24 | 0.30 | 0.35 | 0.19 | 0.79 | 0.23 |

TABLE 2-continued

Summary of results of Examples 6 to 13

| | Example 6 | Example 7 | Example 8 | Example 9 | Example 10 | Example 11 | Example 12 | Example 13 |
|---|---|---|---|---|---|---|---|---|
| Volume % of 20 μm or more [%] | 0.05 | 0.06 | 0.11 | 0.05 | 0.10 | 0.05 | 0.50 | 0.08 |
| Number % of 5 μm or less [%] | 24.0 | 24.3 | 24.0 | 24.2 | 24.2 | 24.3 | 24.1 | 24.1 |
| Development performance White streak ($T12^{10,000}$) | >10,000 | >10,000 | >10,000 | >10,000 | >10,000 | >10,000 | >10,000 | >10,000 |

What is claimed is:

1. A method for producing a toner comprising:

a process of providing colored polymer particles; and a process P4 of mixing the colored polymer particles and outer-additives by a mixer with an agitating blade, wherein a shaft portion of the agitating blade is sealed by a gas with a flow rate in a range from 0.4 $m^3$/hr to 3 $m^3$/hr, and wherein the agitating blade rotates at a tip speed in a range from 20 m/sec to 50 m/sec.

2. The method for producing the toner as set forth in claim 1, wherein the colored polymer particles have a particle diameter distribution in which:

particles having a particle diameter of 12.7 μm or more are 3% by volume or less;

particles having a particle diameter of from 2 μm to 4 μm are in a range from 3% by number to 8% by number; and particles having a particle diameter of 4 μm to 5 μm are in a range from 5% by number to 12% by number.

3. The method for producing the toner as set forth in claim 1, wherein a quantity of the colored polymer particles per unit volume inside the mixer is in a range from 0.05 kg/liter to 0.4 kg/liter.

4. The method for producing the toner as set forth in claim 1, wherein the colored polymer particles have a sphericity from 1 to 1.3.

5. The method for producing the toner as set forth in claim 1, wherein the outer-additives comprise silica fine particles (A) having a number average particle diameter from 5 nm to 18 nm.

6. The method for producing the toner as set forth in claim 5, wherein the outer-additives further comprise particles (C) selected from a group consisting of organic particles and inorganic particles, having a number average particle diameter from 0.1 μm to 1 μm.

7. The method for producing the toner as set forth in claim 6, wherein the outer-additives further comprise silica fine particles (B) having a number average particle diameter from 20 nm to 50 nm.

8. The method for producing the toner as set forth in claim 1, wherein the process of providing the colored polymer particles comprises a process P3 of removing large-size particles from unrefined colored polymer particles to obtain the colored polymer particles.

9. The method for producing the toner as set forth in claim 8, wherein the process P3 comprises the steps of:

providing the unrefined colored polymer particles by pneumatic conveyor to a screen having an opening in a range from 5 μm to 40 μm; and eliminating the large-size particles from the unrefined colored polymer particles by the screen to obtain the colored polymer particles.

10. The method for producing the toner as set forth in claim 9, wherein head loss of the screen is 3.5 kPa or less.

11. The method for producing the toner as set forth in claim 8, wherein the process P3 comprises the step of adding 0.01 part by weight to 1.5 part by weight of fine particles (D) to 100 parts by weight of the unrefined colored polymer particles, wherein the fine particles (D) have a number average particle diameter from 5 nm to 20 nm.

12. The method for producing the toner as set forth in claim 9, wherein the process P3 further comprises the step of supplying the unrefined colored polymer particles to the pneumatic conveyor via an ejector to disperse the unrefined colored polymer particles in air.

13. The method for producing the toner as set forth in claim 9, wherein a density De of the unrefined colored polymer particles is in a range from 100 g/$m^3$ to 500 g/$m^3$;

De=V/W (g/$m^3$);

V (g/min) represents a supply rate of the unrefined colored polymer particles to the pneumatic conveyor; and W ($m^3$/min) represents a flow rate of air in the pneumatic conveyor.

14. The method for producing the toner as set forth in claim 8, wherein the process of providing the colored polymer particles further comprises:

a process P1 of separating the unrefined colored polymer particles in a wet state from an aqueous dispersion of the unrefined colored polymer particles with a solid-liquid separator; and a process P2 of drying the unrefined colored polymer particles in a wet state to obtain the unrefined colored polymer particles in a dry state for the process P3.

15. The method for producing the toner as set forth in claim 14, wherein the solid-liquid separator comprises a filter made of a porous metal.

16. The method for producing the toner as set forth in claim 15, wherein the solid-liquid separator is a basket type centrifugal filter system.

17. The method for producing the toner as set forth in claim 14, wherein the process P2 comprises the step of vacuum-drying the unrefined colored polymer particles in a wet state with a vacuum dryer with an agitating blade at a transfer ratio R in a range from 40 to 500;

wherein the transfer ratio R is described as R=X*Y/Z,

X ($m^3$/hr) represents a transfer flow rate of the agitating blade of the vacuum dryer, Y (hr) represents a drying time, and Z ($m^3$) represents a volume of the unrefined colored polymer particles in a wet state provided into the vacuum dryer.

18. A toner produced by the method set forth in claim 1.

* * * * *